US010633727B2

(12) United States Patent
Garza-Martinez et al.

(10) Patent No.: US 10,633,727 B2
(45) Date of Patent: Apr. 28, 2020

(54) LOW ALLOY THIRD GENERATION ADVANCED HIGH STRENGTH STEEL

(71) Applicant: AK Steel Properties, Inc., West Chester, OH (US)

(72) Inventors: Luis Gonzalo Garza-Martinez, Wyoming, OH (US); Grant Aaron Thomas, Liberty Township, OH (US)

(73) Assignee: AK Steel Properties, Inc., West Chester, OH (US)

( * ) Notice: Subject to any disclaimer, the term of this patent is extended or adjusted under 35 U.S.C. 154(b) by 730 days.

(21) Appl. No.: 15/160,714

(22) Filed: May 20, 2016

(65) Prior Publication Data

US 2016/0340761 A1 Nov. 24, 2016

Related U.S. Application Data

(60) Provisional application No. 62/164,231, filed on May 20, 2015.

(51) Int. Cl.

| | |
|---|---|
| ***C21D 11/00*** | (2006.01) |
| ***C21D 1/26*** | (2006.01) |
| ***C21D 6/00*** | (2006.01) |
| ***C21D 9/52*** | (2006.01) |
| ***C22C 38/02*** | (2006.01) |

(Continued)

(52) U.S. Cl.

CPC ..... *C22C 38/06* (2013.01); *C21D 1/26* (2013.01); *C21D 6/005* (2013.01); *C21D 8/0263* (2013.01); *C21D 9/52* (2013.01); *C21D 11/00* (2013.01); *C22C 38/02* (2013.01); *C22C 38/04* (2013.01); *C22C 38/12* (2013.01); *C21D 6/008* (2013.01); *C21D 8/0226* (2013.01); *C21D 2211/001* (2013.01); *C21D 2211/005* (2013.01)

(58) Field of Classification Search

None

See application file for complete search history.

(56) References Cited

U.S. PATENT DOCUMENTS

| | | | |
|---|---|---|---|
| 2010/0139816 | A1 | 6/2010 | Hanlon et al. |
| 2014/0166163 | A1 | 6/2014 | Jamwal et al. |

(Continued)

FOREIGN PATENT DOCUMENTS

| | | |
|---|---|---|
| CN | 101627142 A | 1/2010 |
| JP | 2005-133201 | 5/2005 |

(Continued)

OTHER PUBLICATIONS

International Search Report and Written Opinion dated Jul. 21, 2016 for PCT/US2016/033605, 19 pgs.

(Continued)

*Primary Examiner* — Colin W. Slifka

(74) *Attorney, Agent, or Firm* — Frost Brown Todd LLC

(57) ABSTRACT

A high strength steel comprises, during intercritical annealing, about 20-80% volume ferrite and 20-80% austenite, and wherein the Ms temperature calculated for the austenite phase during intercritical anneal ≤100° C. The high strength steel exhibits a tensile elongation of at least 20% and an ultimate tensile strength of at least 880 MPa. The high strength steel may comprise 0.20-0.30 wt % C, 3.0-5.0 wt % Mn, with Al and Si additions such that the optimum intercritical temperature is above 700° C.

9 Claims, 20 Drawing Sheets

Phase fraction for alloy 41 versus temperature in °C. Calculated with ThermoCalc®

(51) Int. Cl.

| | |
|---|---|
| ***C22C 38/04*** | (2006.01) |
| ***C22C 38/06*** | (2006.01) |
| ***C22C 38/12*** | (2006.01) |
| ***C21D 8/02*** | (2006.01) |

(56) References Cited

U.S. PATENT DOCUMENTS

| | | | | |
|---|---|---|---|---|
| 2016/0312323 | A1* | 10/2016 | Rana | C21D 9/0068 |
| 2017/0114433 | A9* | 4/2017 | Jun | C22C 38/00 |

FOREIGN PATENT DOCUMENTS

| | | |
|---|---|---|
| JP | 2005-200694 | 7/2005 |
| JP | 2012-180570 | 9/2012 |
| JP | 2013-040382 | 2/2013 |
| JP | 2013-040383 | 2/2013 |
| JP | 2013-237923 | 11/2013 |
| JP | 2014-019879 | 2/2014 |
| JP | 2014-062286 | 4/2014 |
| RU | 2009105578 | 8/2010 |
| WO | WO 2015/001414 | 1/2015 |
| WO | WO 2016/067623 | 5/2016 |

OTHER PUBLICATIONS

Australian Office Action dated Jun. 22, 2018 for Application No. 2016264749, 3 pgs.
Canadian Office Action dated Oct. 15, 2018 for Application No. 2,984,029, 4 pgs.
Chinese Office Action dated Nov. 8, 2018 for Application No. 201680029287.8, 11 pgs.
Colombian Office Action dated Nov. 16, 2017 for Application No. NC2017/0011538, 4 pgs.
European Communication dated Jan. 4, 2018 for Application No. 16726750.9, 3 pgs.
Russian Office Action dated Nov. 14, 2018 for Application No. 2017141034, 10 pgs.
Taiwanese Office Action dated Oct. 18, 2017 for Application No. 105115894, 9 pgs.
Canadian Office Action dated Jun. 4, 2019 for Application No. 2,984,029, 4 pgs.
Chinese Office Action dated Jul. 5, 2019 for Application No. 201680029287.8, 7 pgs.
Colombian Office Action dated May 31, 2019 for Application No. NC2017/0011538, 13 pgs.
Japanese Office Action dated Aug. 20, 2019 for Application No. 2017-560597, 12 pgs.
Korean Office Action dated Apr. 1, 2019 for Application No. 10-2017-7036822, 8 pages.
Russian Office Action dated Mar. 5, 2019 for Application No. 2017141034, 9 pgs.

* cited by examiner

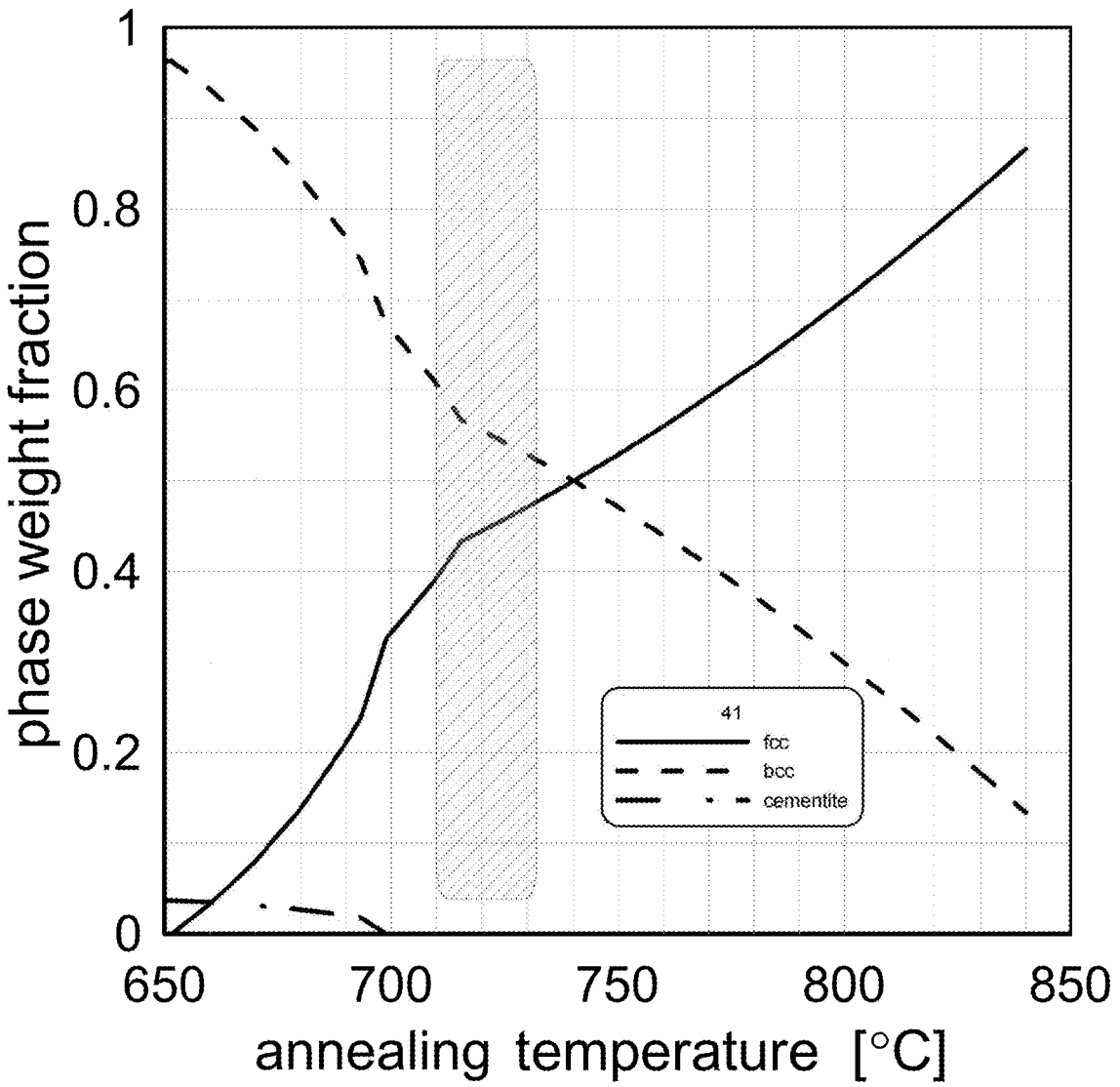
Fig. 1 Phase fraction for alloy 41 versus temperature in °C. Calculated with ThermoCalc®

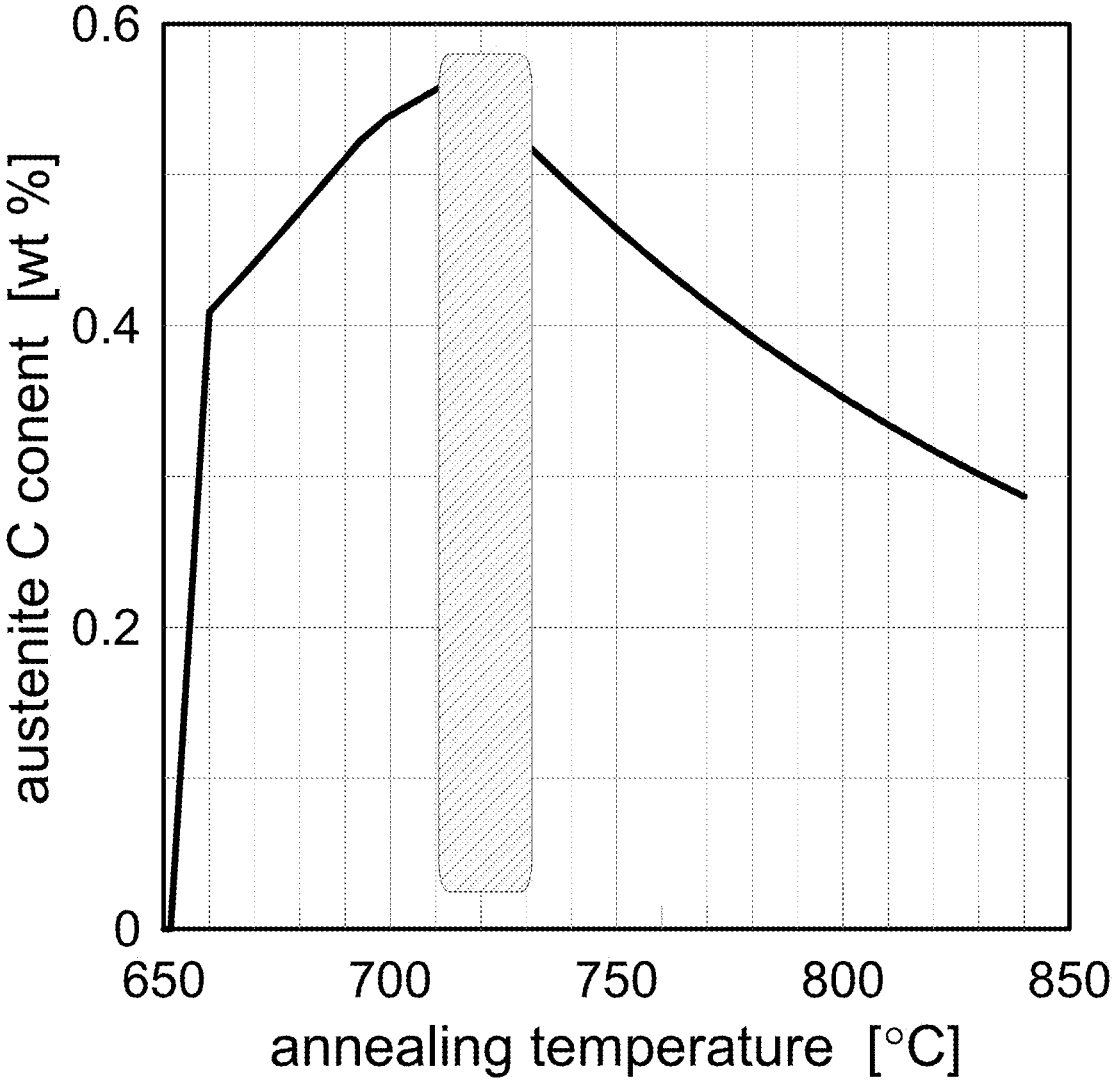
Fig. 1a C content in the austenite for alloy 41 versus temperature in °C. Calculated with ThermoCalc®

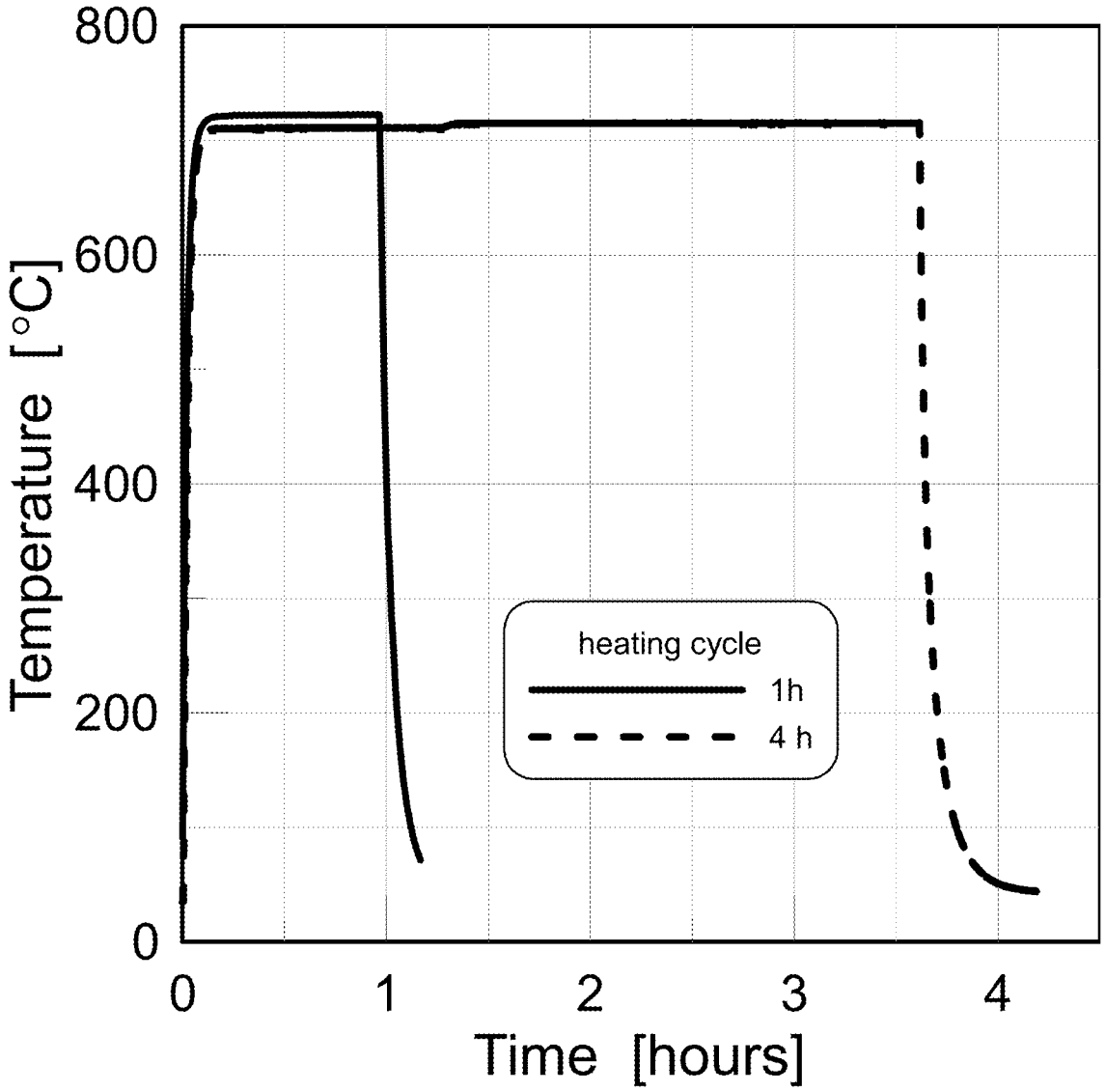
Figure 2 Optimum intercritical heat treatment, thermal cycle.

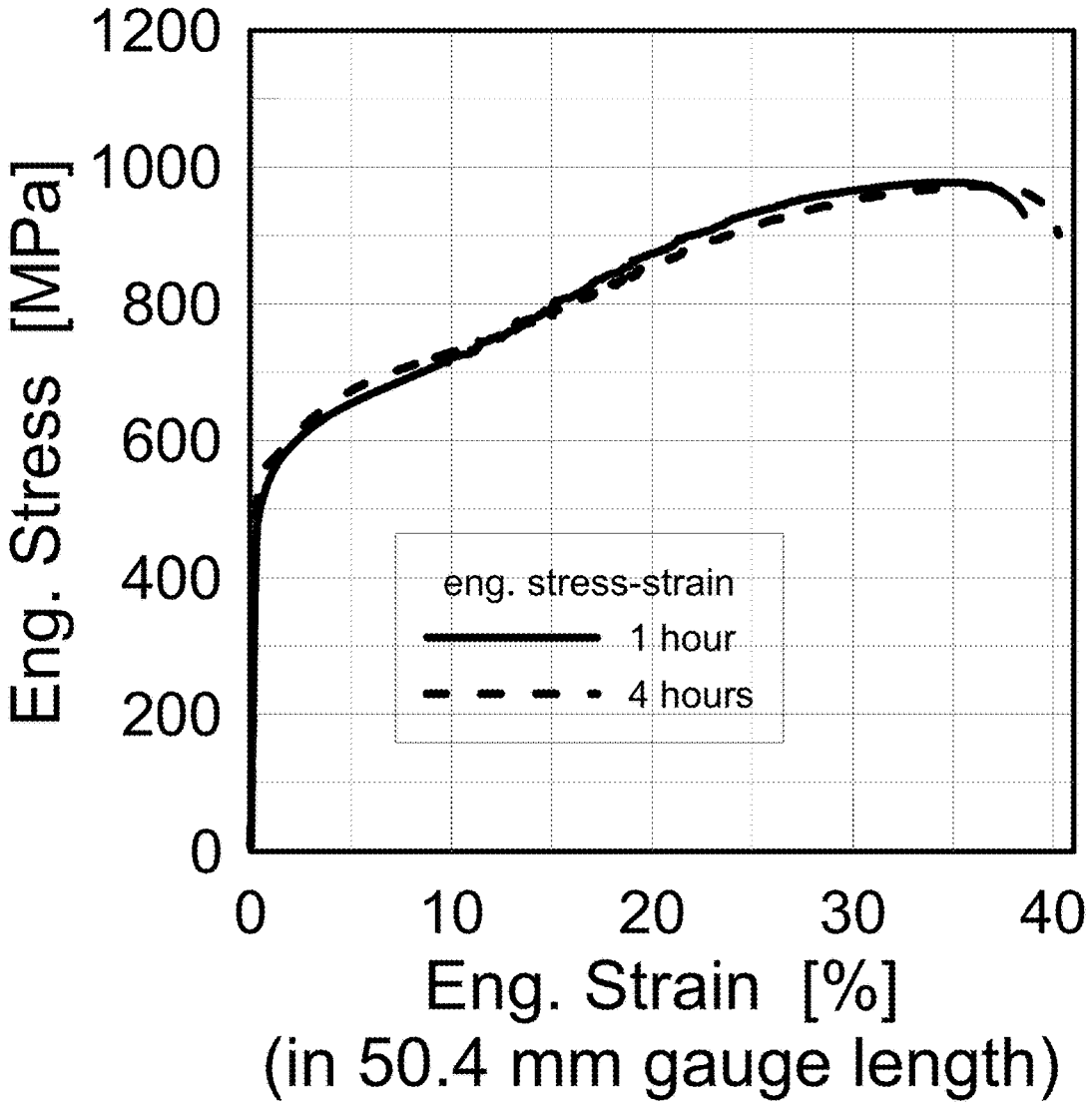
Figure 3 Engineering stress – engineering strain curve of optimum intercritical heat treated strip.

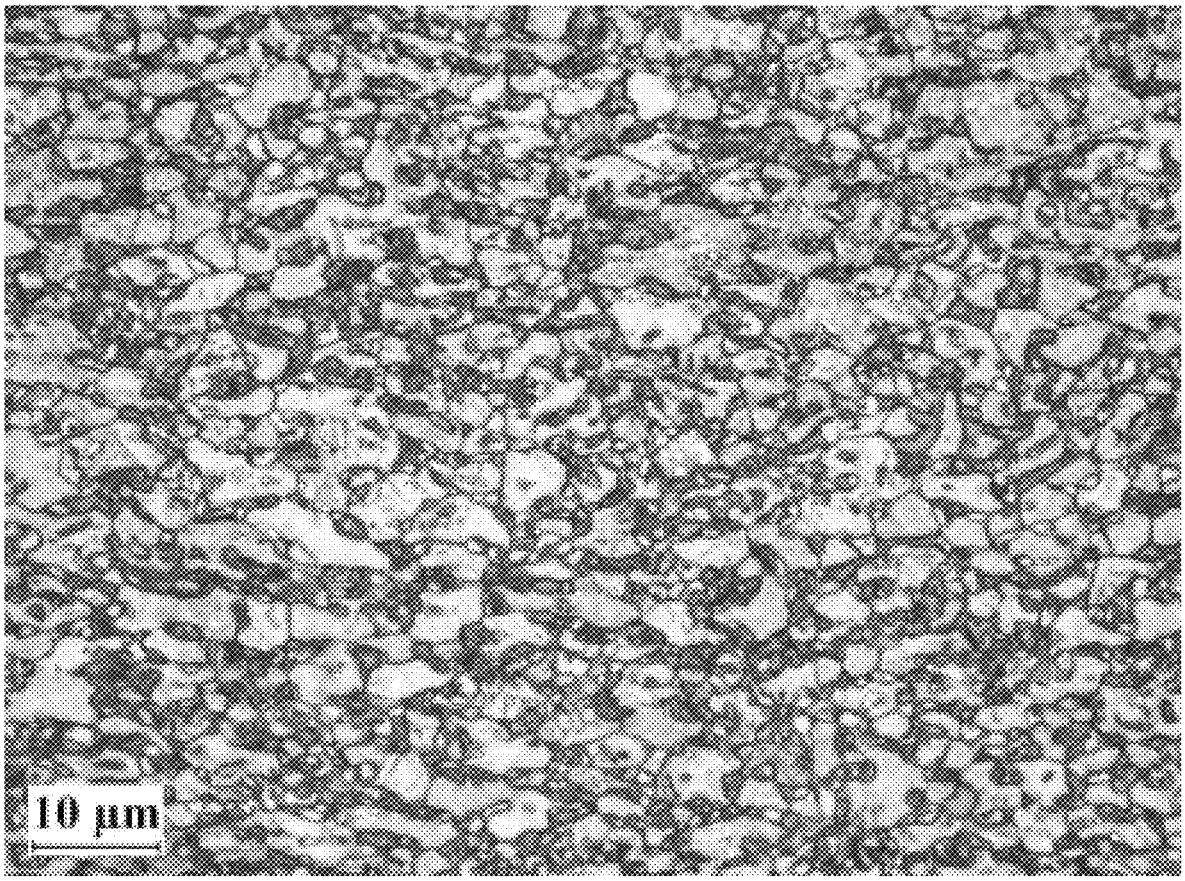
Figure 4 Light optical microstructure of optimum intercritical annealing for 1 hour. The microstructure consisted of ferrite (blue), martensite (brown), and austenite (white).

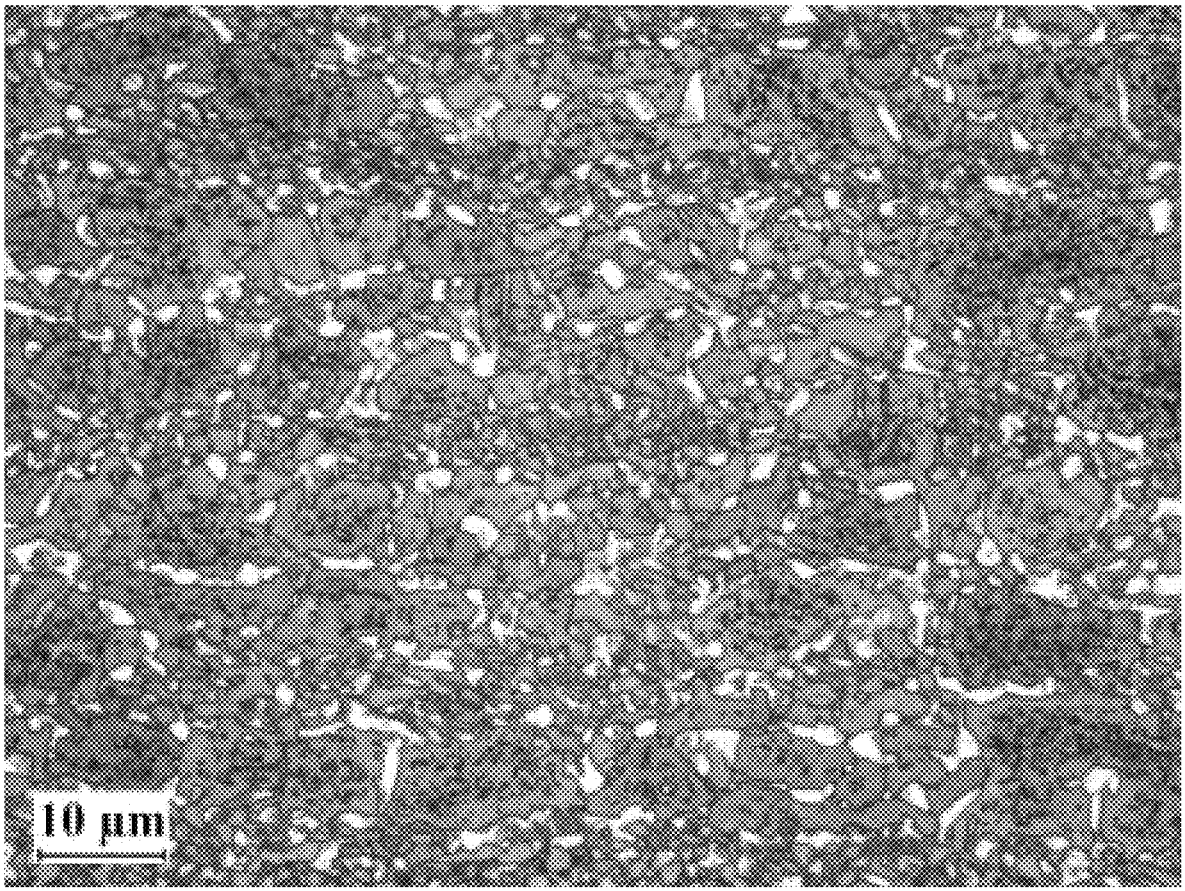
Figure 5 Light optical microstructure of optimum intercritical annealing for 4 hours. The microstructure consisted of ferrite (blue), martensite (brown), and austenite (white).

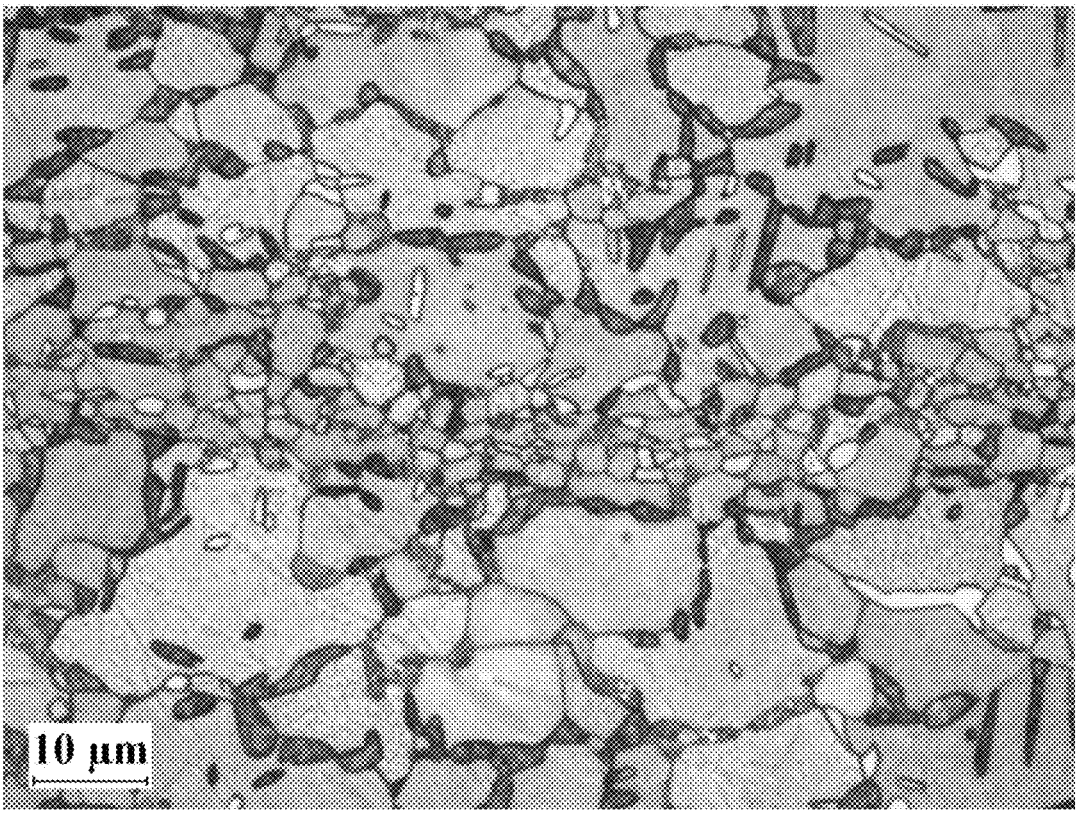
Figure 6 Light optical microstructure of hot band batch annealed at the optimum intercritical temperature for alloy 41. The microstructure includes a matrix of ferrite, martensite, and retained austenite.

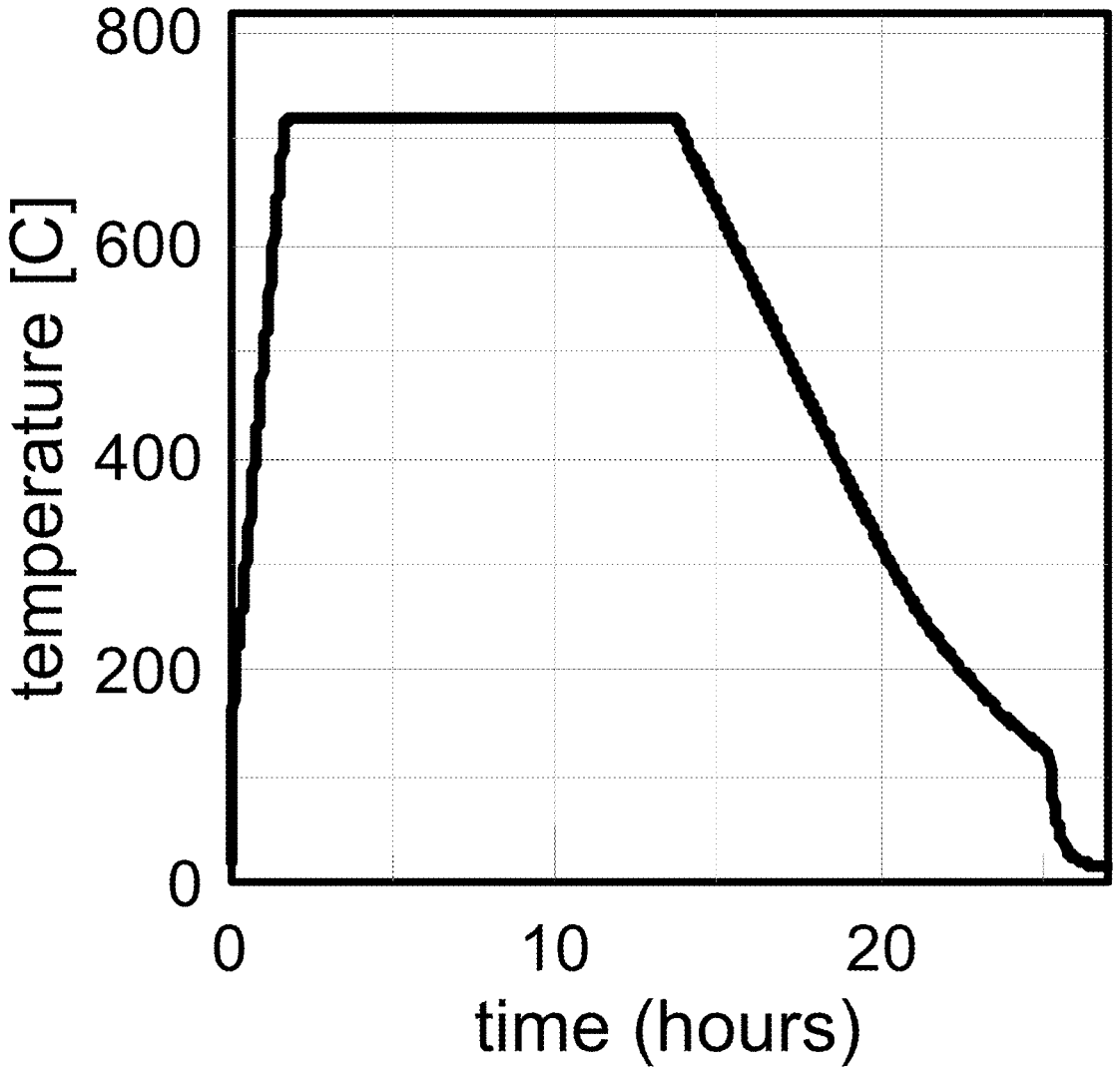
Figure 7 Batch annealing thermal cycle.

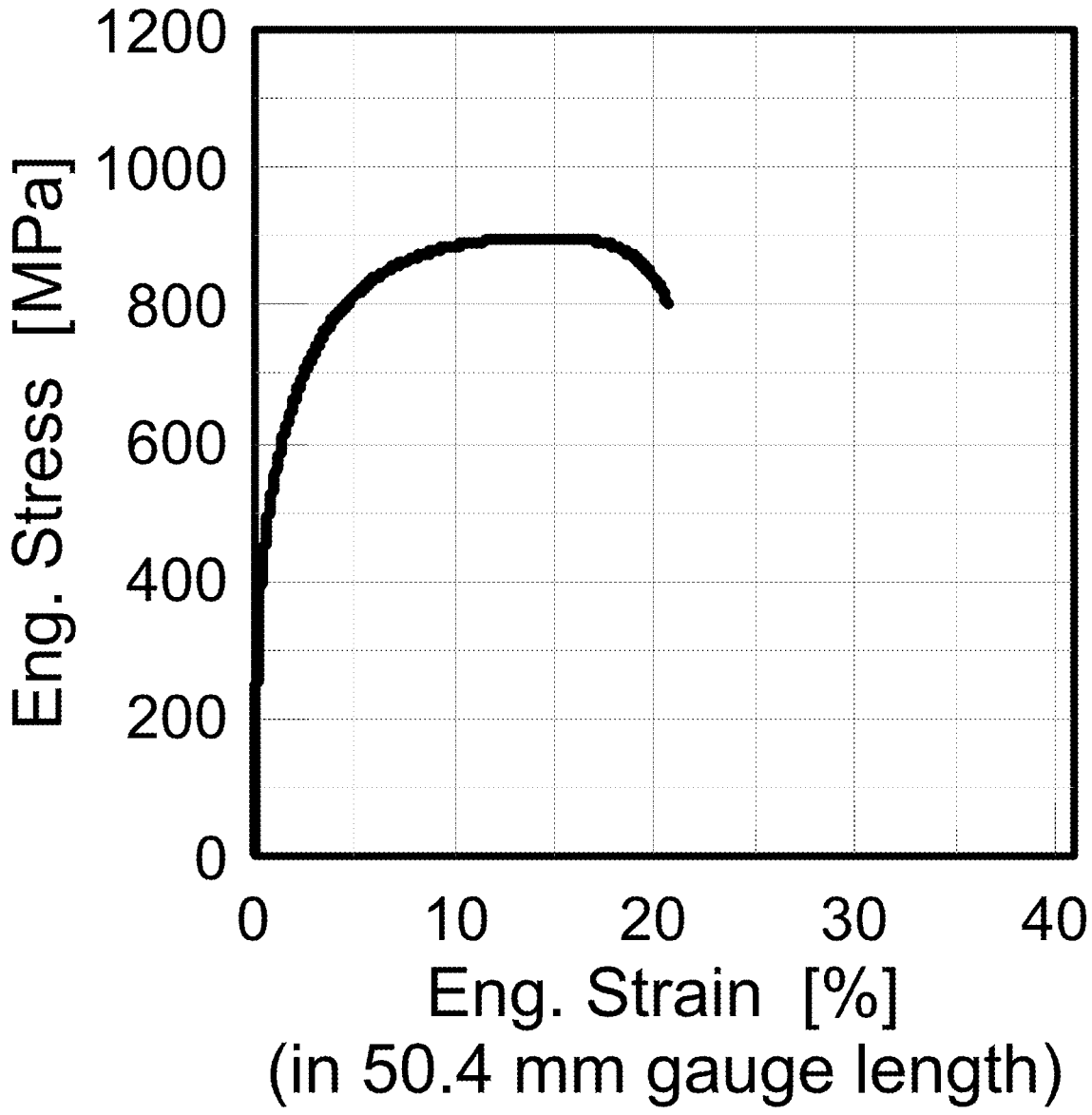
Figure 8 Engineering stress – engineering strain curve of batch annealed heat treated strip.

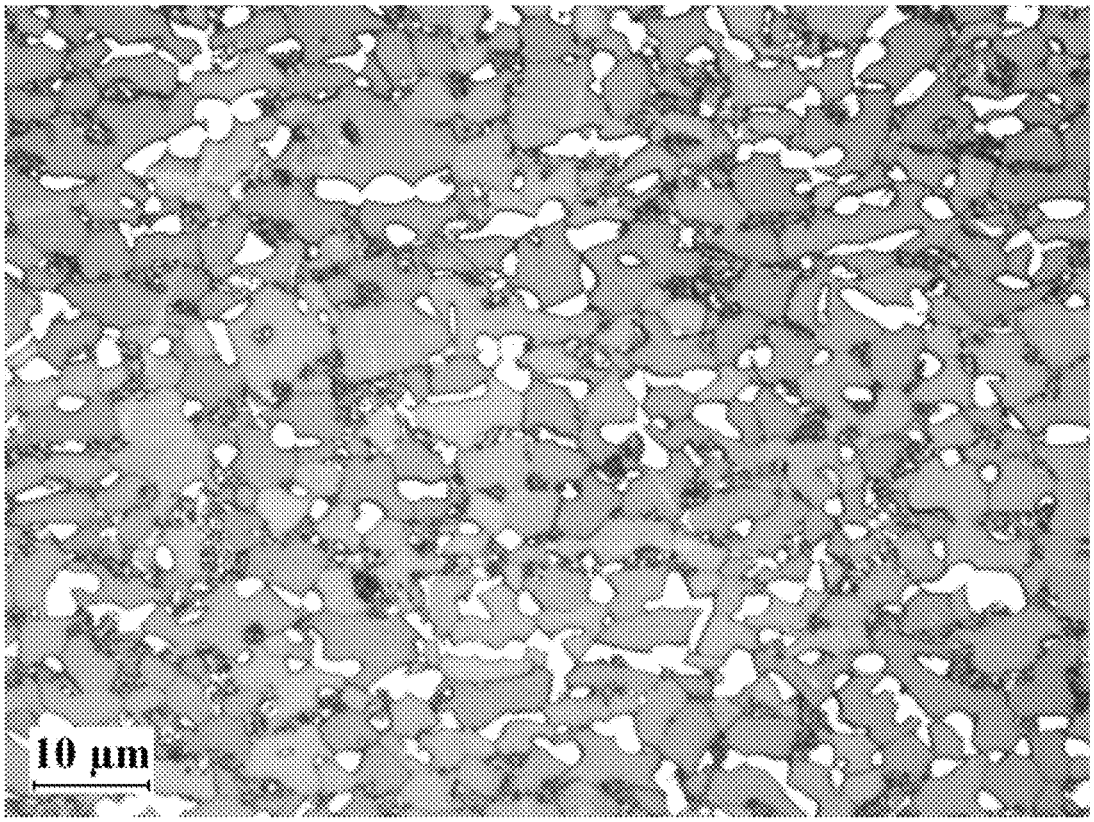
Figure 9 Light optical microstructure of batch annealing at optimum temperature alloy 41. The microstructure includes a matrix of ferrite (brown), martensite (white), carbides and retained austenite.

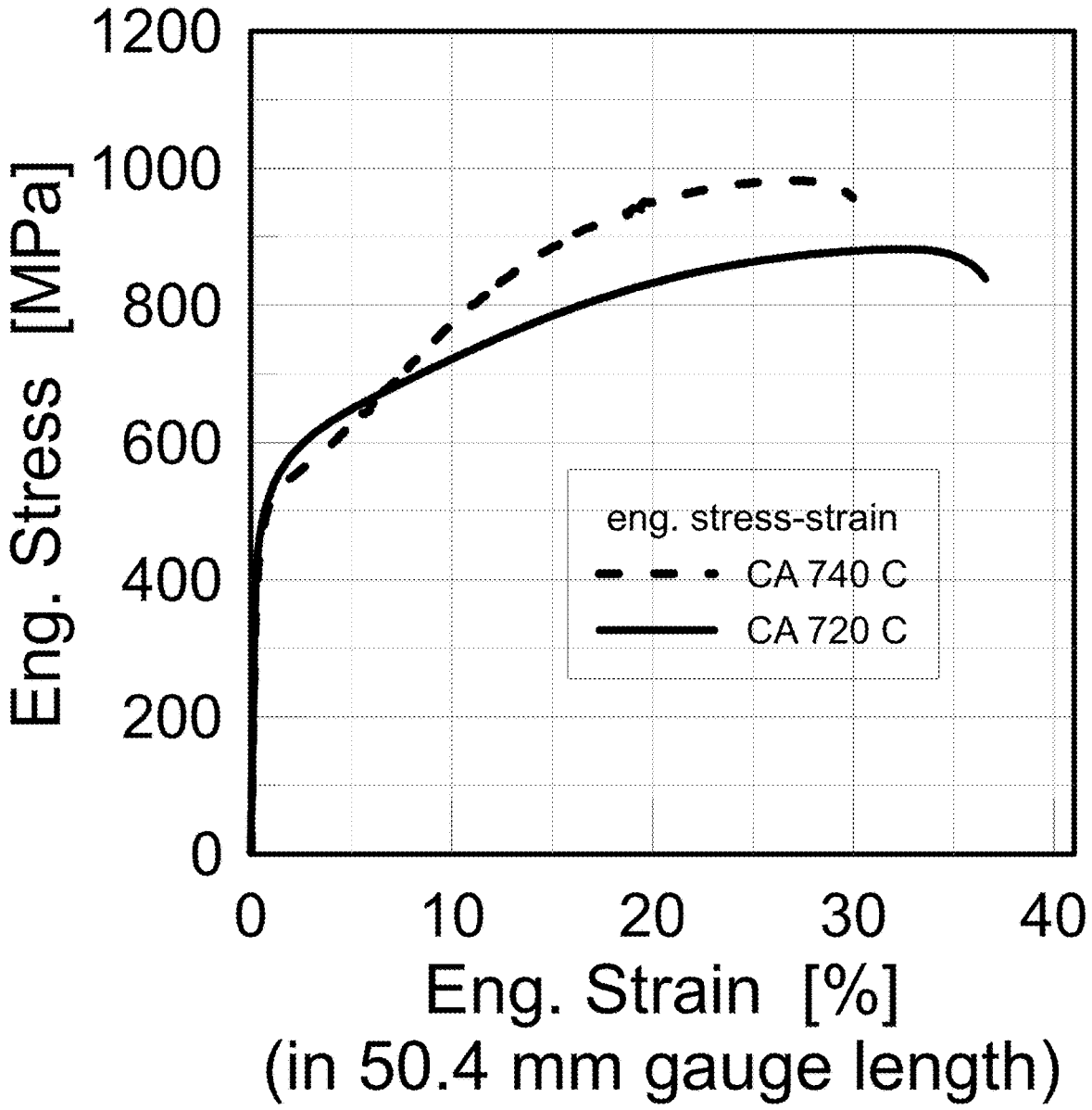
Figure 10 Engineering stress – engineering strain curve of batch annealed and then continuous annealed simulated steel at temperatures of 720 and 740 °C.

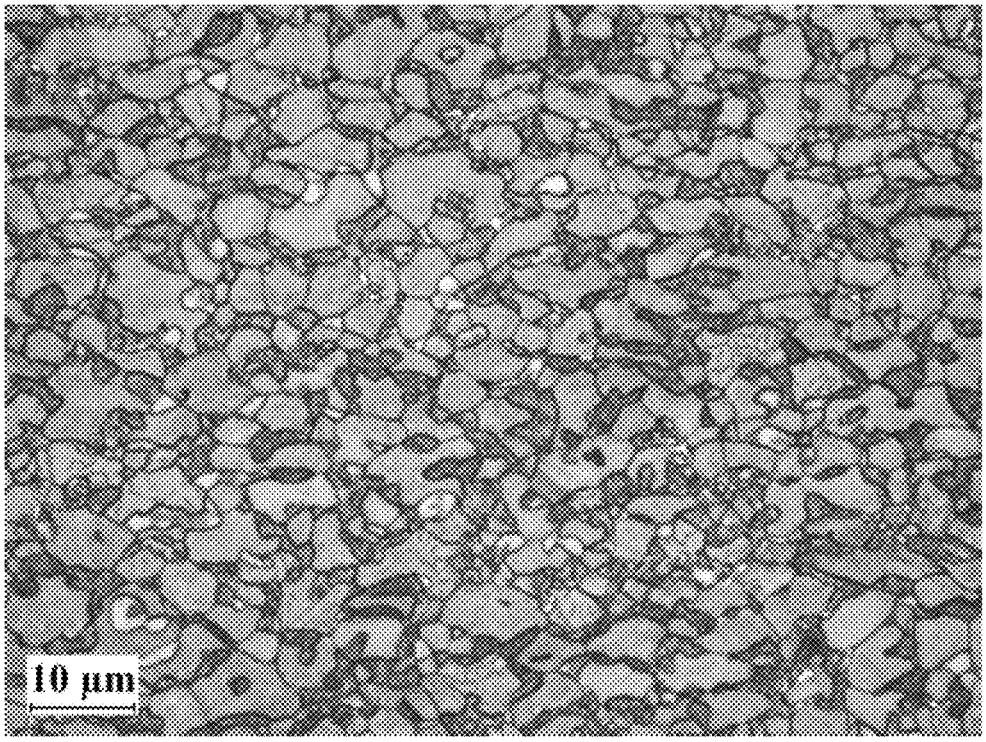
Figure 11 Light optical microstructure of batch annealed at optimum temperature of 720 °C and then continuously annealed simulated at 720 °C in salt pot furnace for 5 min. The microstructure consisted of ferrite (blue), martensite (brown), and austenite (white).

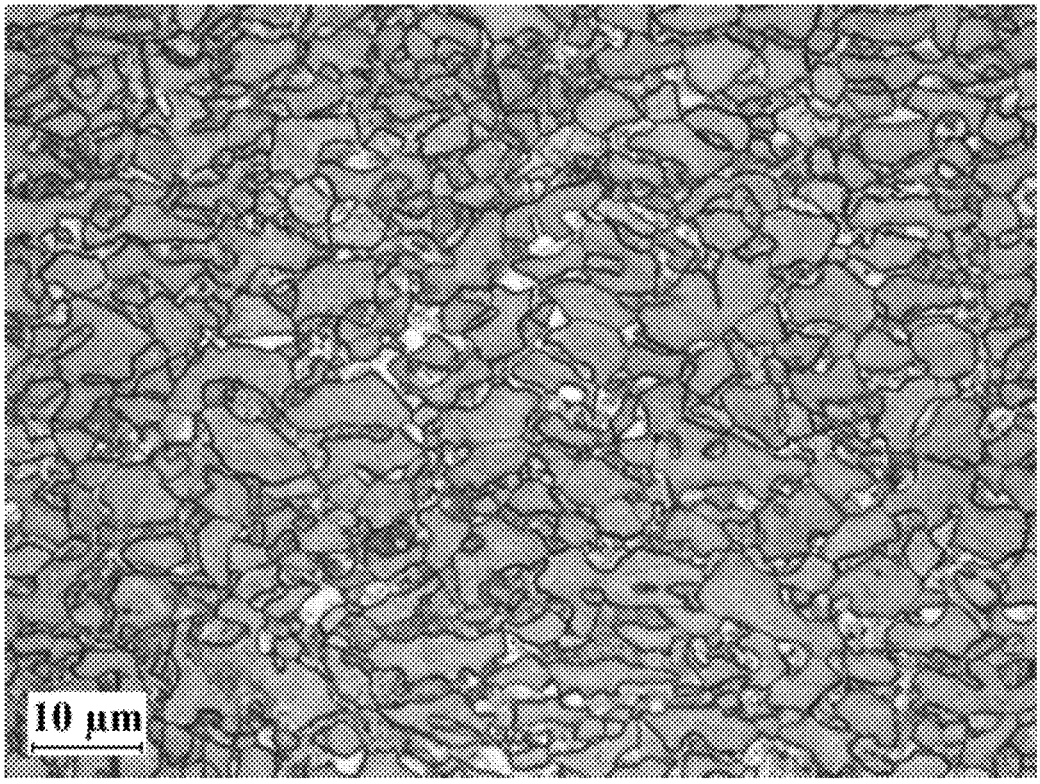
Figure 12 Light optical microstructure of batch annealed at optimum temperature of 720 °C and then continuously annealed simulated at 740 °C in salt pot furnace for 5 min. The microstructure consisted of ferrite (blue), martensite (brown), and austenite (white).

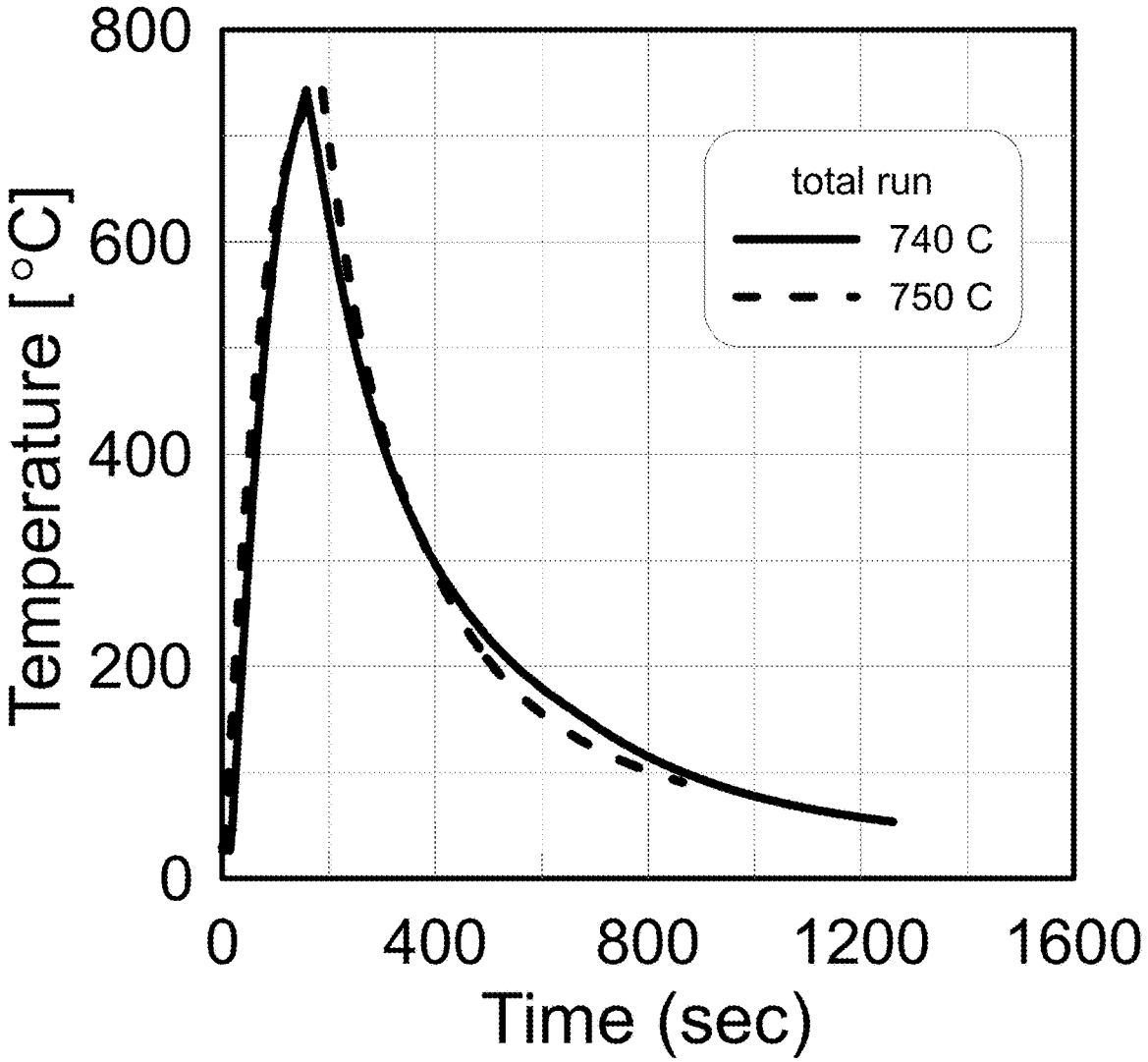
Figure 13 Continuously annealing thermal cycle.

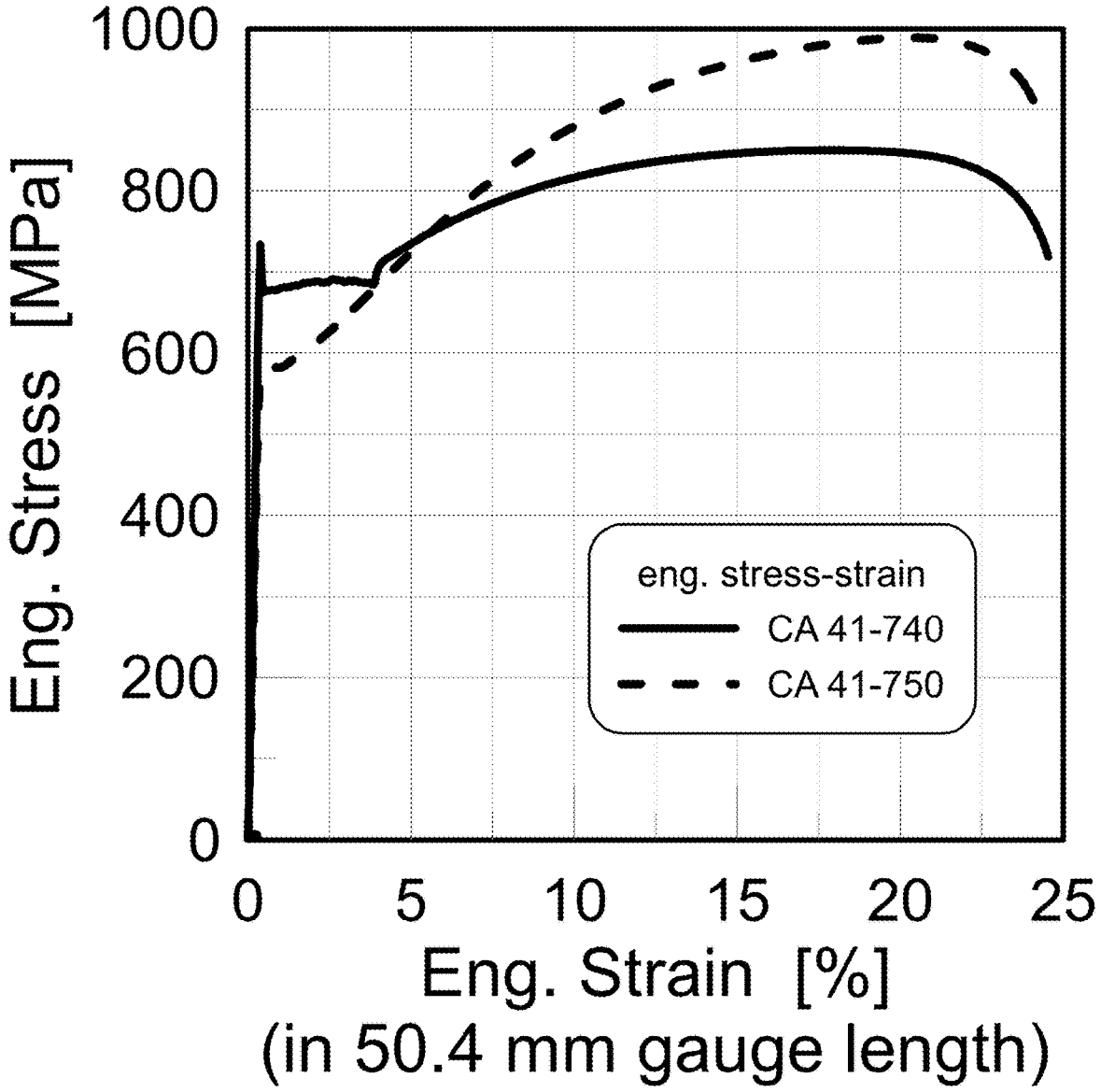
Figure 14 Engineering stress – engineering strain curve of continuously annealed heat treated strip.

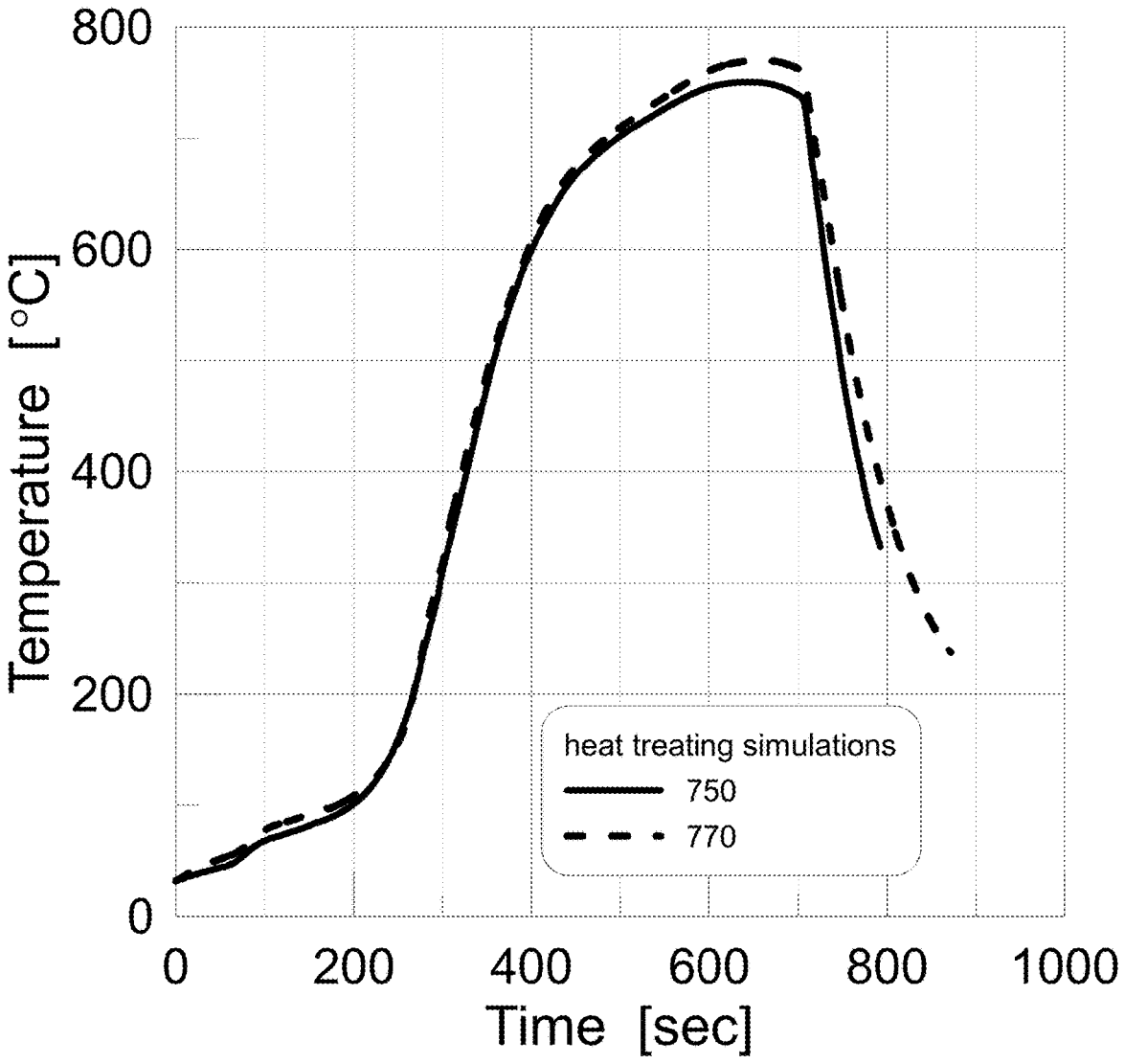
Figure 15 Continuously annealing temperature cycle, similar to a hot-dip coating line

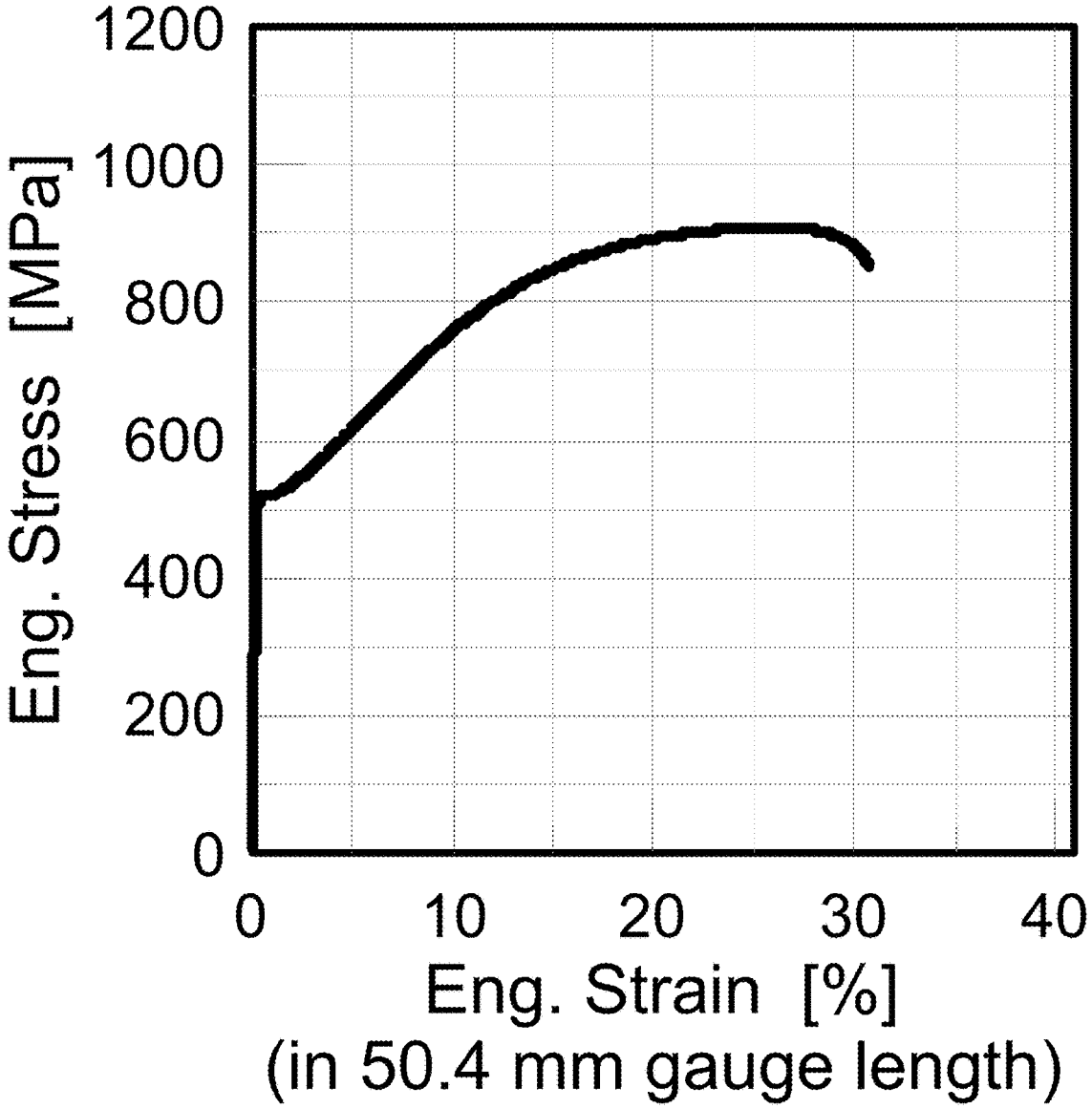
Figure 16 Engineering stress-engineering strain curve of simultaneously annealed steel, using a hot dip galvanized line temperature cycle with a peak metal temperature of 755 °C.

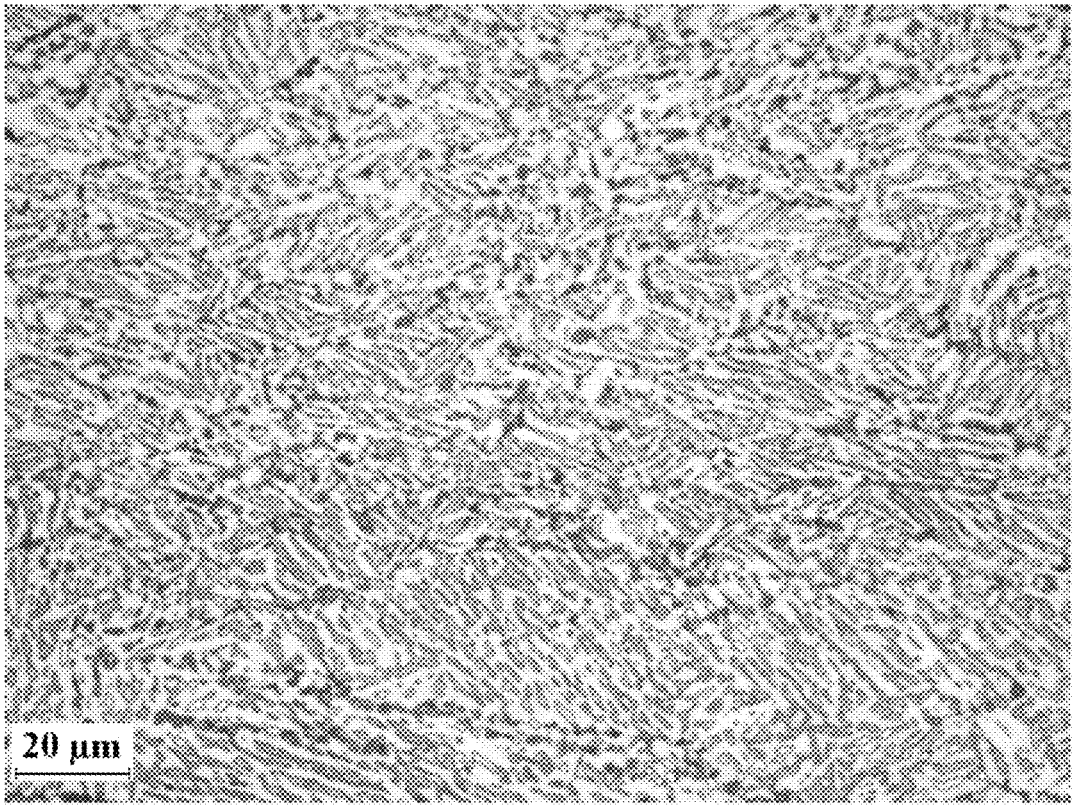
Figure 17 Light optimal microstructure of batch annealed hot band. The microstructure includes a fine dispersion of ferrite martensite, and retained austenite

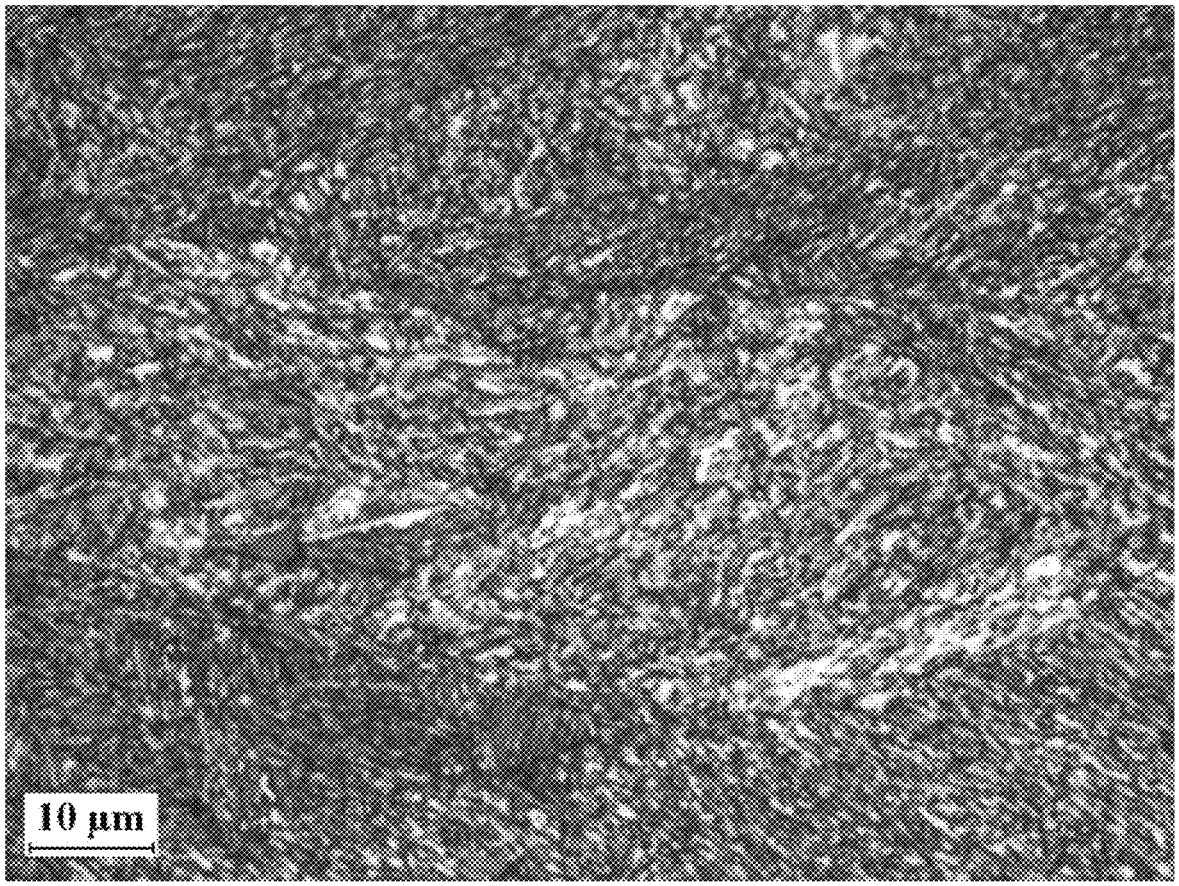
Figure 18 Light optical micrograph of Alloy 61 hot band, continuously annealed in a belt furnace, simulation annealing/pickling process.

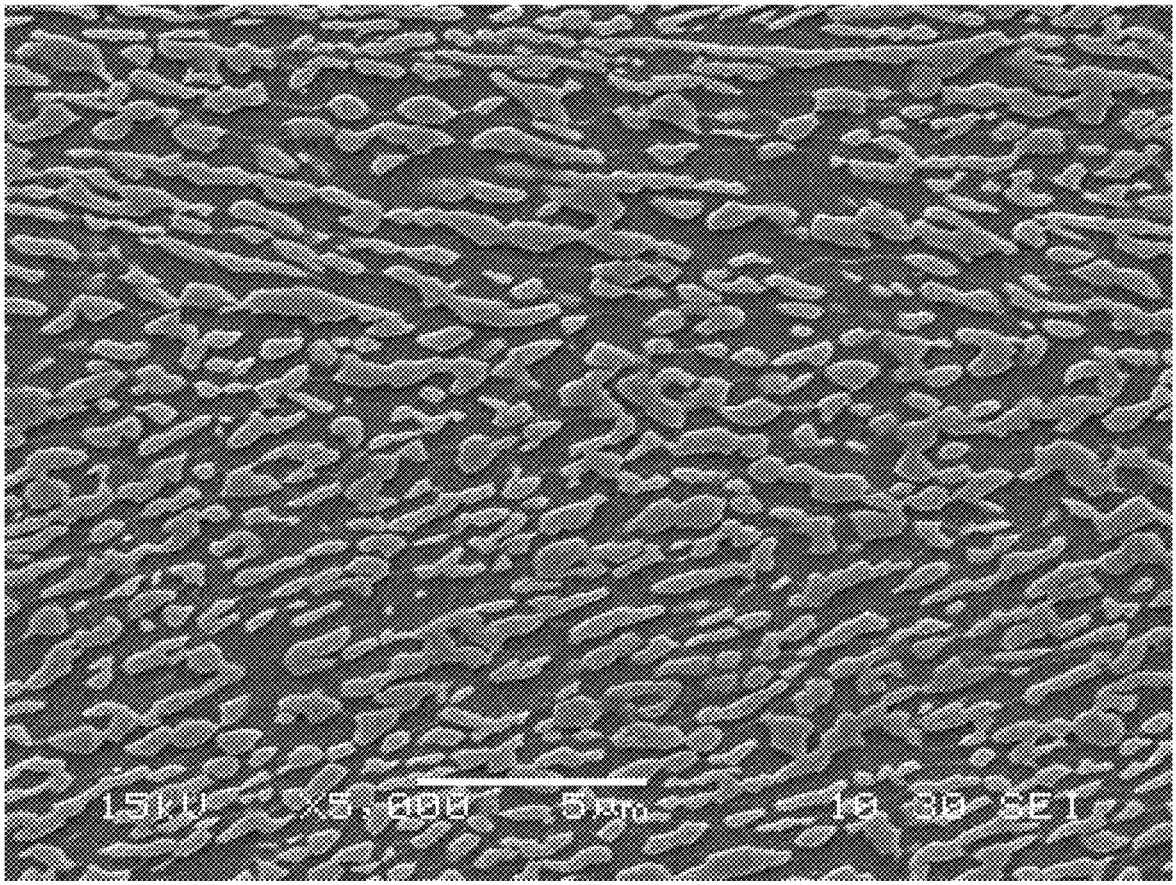
Figure 19 Scanning electron microscope image of alloy 61, intercritical annealed / cold reduced, and continuously annealed at a temperature of 757 °C. The matrix includes ferrite, while the second phase is a fine dispersion of austenite.

LOW ALLOY THIRD GENERATION ADVANCED HIGH STRENGTH STEEL

PRIORITY

This application claims priority to U.S. Provisional Application Ser. No. 62/164,231, entitled LOW ALLOY 3$^{RD}$ GENERATION ADVANCED HIGH STRENGTH STEEL OBTAINED BY OPTIMAL INTERCRITICAL ANNEALING filed on May 20, 2015, the disclosure of which is incorporated by reference herein.

BACKGROUND

The automotive industry continually seeks more cost-effective steels that are lighter for more fuel efficient vehicles and stronger for enhanced crash-resistance, while still being formable. The steels being developed to meet these needs are generally known as third generation advanced high strength steels. The goal for these materials is to lower the cost compared to other advanced high strength steels by reducing the amount of expensive alloys in the compositions, while still improving both formability and strength.

Dual phase steels, considered a first generation advanced high strength steel, have a microstructure comprised of a combination of ferrite and martensite that results in a good strength-ductility ratio, where the ferrite provides ductility to the steel, and the martensite provides strength. One of the microstructures of third generation advanced high strength steels utilizes ferrite, martensite, and austenite (also referred to as retained austenite). In this three-phase microstructure, the austenite allows the steel to extend its plastic deformation further (or increase its tensile elongation percentage). When austenite is subjected to plastic deformation, it transforms to martensite and increases the overall strength of the steel. Austenite stability is the resistance of austenite to transform to martensite when subjected to temperature, stress, or strain. Austenite stability is controlled by its composition. Elements like carbon and manganese increase the stability of austenite. Silicon is a ferrite stabilizer however due to its effects on hardenability, the martensite start temperature (Ms), and carbide formation, Si additions can increase the austenite stability also.

Intercritical annealing is a heat treatment at a temperature where crystal structures of ferrite and austenite exist simultaneously. At intercritical temperatures above the carbide dissolution temperature, the carbon solubility of ferrite is minimal; meanwhile the solubility of C in the austenite is relatively high. The difference in solubility between the two phases has the effect of concentrating the C in the austenite. For example, if the bulk carbon composition of a steel is 0.25 wt %, if there exists 50% ferrite and 50% austenite, at the intercritical temperature the carbon concentration in the ferrite phase is close to 0 wt %, while the carbon in the austenite phase is now 0.50 wt %. For the carbon enrichment of the austenite at the intercritical temperature to be optimal, the temperature should also be above the cementite (Fe3C) or carbide dissolution temperature, i.e., the temperature at which cementite or carbide dissolves. This temperature will be referred to as the optimum intercritical temperature. The optimum intercritical temperature where the optimum ferrite/austenite content occurs is the temperature region above cementite (Fe3C) dissolution and the temperature at which the carbon content in the austenite is maximized.

The ability to retain austenite at room temperature depends on how close the Ms temperature is to room temperature. The Ms temperature can be calculated using the following equation:

$$M_s=607.8-363.2*[C]-26.7*[Mn]-18.1*[Cr]-38.6*[Si]-962.6*([C]-0.188)^2 \quad \text{Eqn. 1}$$

Where Ms is expressed in ° C., and the element content is in wt %.

SUMMARY

A high strength steel comprises, during intercritical annealing, about 20-80% volume ferrite and 20-80% austenite, and wherein the Ms temperature calculated for the austenite phase during intercritical anneal ≤100° C. The intercritical annealing can occur in a batch process. Alternatively, the intercritical annealing can occur in a continuous process. The high strength steel exhibits a tensile elongation of at least 20% and an ultimate tensile strength of at least 880 MPa.

The high strength steel may comprise 0.20-0.30 wt % C, 3.0-5.0 wt % Mn, with Al and Si additions such that the optimum intercritical temperature is above 700° C. The high strength steel alternatively may comprise 0.20-0.30 wt % C, 3.5-4.5 wt % Mn, 0.8-1.3 wt % Al, 1.8-2.3 wt % Si. Or the high strength steel may comprise 0.20-0.30 wt % C, 3.5-4.5 wt % Mn, 0.8-1.3 wt % Al, 1.8-2.3 wt % Si, 0.030-0.050 wt % Nb.

After hot rolling, the high strength steel can have a tensile strength of at least 1000 MPa, and a total elongation of at least 15%. In some embodiments, the high strength steel has a tensile strength of at least 1300 MPa, and a total elongation of at least 10% after hot rolling. In other embodiments, the high strength steel has a tensile strength of at least 1000 MPa and a total elongation of at least 20%. after hot rolling and continuous annealing.

A method of annealing a steel strip comprises the steps of: selecting an alloy composition for said steel strip; determining the optimum intercritical annealing temperature for said alloy by identifying the temperature at which iron carbides within said alloy are substantially dissolved, and the carbon content of an austenite portion of said strip is at least 1.5 times of that of the bulk strip composition; annealing the strip at said optimum intercritical annealing temperature. The method can further comprise the step of additional intercritically annealing said strip.

DESCRIPTION OF THE DRAWINGS

FIG. 1 depicts the phase fraction for an embodiment of the steel of the present application of example 1, and the carbon content in the austenite, versus temperature in ° C., as calculated with ThermoCalc®.

FIG. 1*a* depicts the carbon content in the austenite for alloy 41 of example 1 versus temperature in ° C. Calculated with ThermoCalc®

FIG. 2 depicts an optimum intercritical heat treatment thermal cycle for the embodiment of the steel of the present application of example 1.

FIG. 3 depicts the engineering stress—engineering strain curve of the optimum intercritical heat treated strip of example 1.

FIG. 4 depicts the light optical microstructure of optimum intercritical annealing for 1 hour for the steel of example 1.

FIG. 5 depicts the light optical microstructure of the optimum intercritical annealing for 4 hours for the steel of example 1.

FIG. 6 depicts the light optical microstructure of hot band batch annealed at the optimum intercritical temperature for alloy 41 of example 1, wherein the microstructure is a matrix of ferrite, martensite, and retained austenite.

FIG. 7 depicts the batch annealing thermal cycle for alloy 41 of example 1.

FIG. 8 depicts the engineering stress—engineering strain curve of batch annealed heat treated strip of alloy 41 of example 1.

FIG. 9 depicts the light optical microstructure of batch annealing at optimum temperature of alloy 41 of example 1.

FIG. 10 depicts the engineering stress—engineering strain curve of batch annealed and then continuous annealed simulated steel of alloy 41 of example 1 at temperatures of 720 and 740° C.

FIG. 11 depicts the light optical microstructure of batch annealed steel of alloy 41 of example 1 at an optimum temperature of 720° C. and then continuously annealed simulated at 720° C. in salt pot furnace for 5 min.

FIG. 12 depicts the light optical microstructure of batch annealed steel of alloy 41 of example 1 at an optimum temperature of 720° C. and then continuously annealed simulated at 740° C. in salt pot furnace for 5 min.

FIG. 13 depicts a continuously annealing thermal cycle for alloy 41 of example 1.

FIG. 14 depicts the engineering stress—engineering strain curve of continuously annealed heat treated strip of alloy 41 of example 1.

FIG. 15 depicts a continuous annealing temperature cycle, similar to a hot-dip coating line, for alloy 41 of example 1.

FIG. 16 depicts an engineering stress-engineering strain curve of simultaneously annealed steel of alloy 41 of example 1, using a hot dip galvanized line temperature cycle with a peak metal temperature of 755° C.

FIG. 17 depicts the light optimal microstructure of batch annealed hot band of steel of alloy 61 of example 7.

FIG. 18 depicts the light optical micrograph of a hot band of alloy 61 of example 7, continuously annealed in a belt furnace, and subject to a simulation annealing/pickling process.

FIG. 19 depicts a scanning electron microscope image of alloy 61 of example 7, intercritical annealed/cold reduced, and continuously annealed at a temperature of 757° C.

DETAILED DESCRIPTION

In the composition of the steel in this present application the amounts of carbon, manganese, and silicon are selected so that when the resulting steel is intercritically annealed, they result in an $M_s$ temperature under 100° C. as calculated using Eqn. 1.

Partitioning of carbon between ferrite and austenite at intercritical temperature occurs by carbon diffusion from the ferrite to the austenite. The diffusion rate of carbon is temperature dependent, the higher the temperature the higher the diffusion rate is. In the steels described in this present application, the intercritical temperature is high enough to allow carbon partitioning (i.e., carbon diffusion from ferrite to austenite) to occur in a practical time, e.g., in one hour or less. Elements like aluminum and silicon increase the transformation temperatures $A_1$ and $A_3$, increasing the temperature where this intercritical region is. When aluminum and silicon are added, the resulting higher intercritical temperature makes it possible to partition the carbon atoms in a practical time, as compared to an alloy with no or lower aluminum and silicon additions where the optimum intercritical temperature is lower.

One embodiment of the steels of the present application comprises 0.20-0.30 wt % C, 3.0-5.0 wt % Mn, with Al and Si additions such that the optimum intercritical temperature is above 700° C. Another embodiment of the steels comprises 0.20-0.30 wt % C, 3.5-4.5 wt % Mn, 0.8-1.3 wt % Al, 1.8-2.3 wt % Si. Another embodiment of the high strength steel comprises 0.20-0.30 wt % C, 3.5-4.5 wt % Mn, 0.8-1.3 wt % Al, 1.8-2.3 wt % Si, 0.030-0.050 wt % Nb.

In one example, the steel contains 0.25 wt % C, 4 wt % Mn, 1 wt % Al, and 2 wt % Si. In this example, the aluminum, and silicon were added to increase the upper and lower transformation temperatures (A3 and A1, respectively) such that the intercritical temperature region results in between 33-66% ferrite and 33-66% austenite at temperatures above 700° C. Niobium can be added to control grain growth at all stages of processing, typically a small micro addition such as 0.040 wt %.

The Ms calculated according to Equation 1 using the bulk composition of a steel that contains 0.25 wt % C, 4 wt % Mn, 1 wt % Al, and 2 wt % Si is about 330° C. When the alloy is intercritically annealed at a temperature where there is 55% ferrite and 45% austenite, the austenite carbon content is about 0.56 wt %, and the calculated $M_s$ temperature for that austenite with the high carbon content is about 87° C., closer to room temperature. When this steel is then cooled from the optimum intercritical temperature to room temperature (25° C.), some of the austenite will transform into martensite, while some will be retained.

As an example, a steel with a manganese content of about 4 wt % Mn, and 0.25 wt % C, is hot rolled in the austenitic phase, and the hot band is coiled and cooled from an elevated temperature (around 600-700° C.) to ambient temperature. Due to the relatively high manganese and carbon content, the steel is hardenable, meaning that it will typically form martensite, even when the cooling rates of the cooling hot band are slow. The aluminum and silicon additions increase the $A_1$ and $A_3$ temperatures by increasing the temperature at which ferrite starts to form, thus promoting ferrite formation and growth. Because the $A_1$ and $A_3$ temperatures are higher, ferrite nucleation and growth kinetics may occur more readily. Thus, when the steel in the current application is cooled from hot rolling, the hot band microstructure includes martensite, and some ferrite, and some retain austenite, carbides, possibly some bainite, and possibly pearlite, and other impurities. With this microstructure, the hot band exhibits high strength, but enough ductility such that it can be cold reduced with little or no need of intermediate heat treatments. Furthermore, the NbC precipitates may act as nucleation sites promoting the ferrite formation, and controlling grain growth.

The forming of ferrite during the cooling of the hot band aids in further processing, not only by providing a softer and more ductile hot band that can be cold reduced, but by ensuring the presence of ferrite in the intercritical annealing. If a microstructure consisting of only martensite and carbides is heated to an intercritical annealing temperature, some martensite is reversed back to austenite and some martensite is tempered and slowly starts to decompose into ferrite and carbides. However, under such circumstances, the formation of ferrite is often sluggish or does not occur at all in a short time. When cooling, the newly reversed austenite will transform into fresh martensite, and the resulting microstructure will be fresh martensite, tempered martensite, a small fraction of ferrite and carbides.

Meanwhile, in the steels of the present application, ferrite already exists in the cold rolled steel, and it does not need to nucleate and grow. When heated to the intercritical temperature, the martensite and carbides will form carbon rich austenite around the already existing ferrite matrix. When cooled the ferrite fraction will be that dictated by the intercritical fraction, some of the austenite will transform to martensite when the temperature goes under the $M_s$ temperature, and some austenite will be retained.

In a batch annealing process for the present steels, the steel is heated to the intercritical region slowly, the steel soaks at a defined temperature for 0-24 hours, and the cooling also occurs slowly. When the batch annealing process is performed at the optimum intercritical temperature, besides partitioning the carbon between the ferrite and the austenite, the manganese is also partitioned. Manganese is a substitutional element and its diffusion is slower compared to that of carbon. The additions of aluminum and silicon, and their effects increasing the transformation temperatures, makes it possible to partition manganese in the time constraints typical of batch annealing. Upon cooling from the batch annealing soaking temperature, the austenite will be richer in carbon and in manganese than the bulk steel composition. When heat treated again to the intercritical temperature as in a continuous annealing process, this austenite will be even more stable, containing most of the carbon and a greater mass fraction of the manganese.

Example 1

Steel Processing: Alloy 41.

An embodiment of the steel of the present application, Alloy 41, was melted and cast following typical steelmaking procedures. The nominal composition of alloy 41 is presented in Table 1. The ingot was cut and cleaned prior to hot rolling. The 127 mm wide×127 mm long×48 mm thick ingot was heated to about 1200° C. for 3 h, and hot rolled to a thickness of about 3.6 mm in about 8 passes. The hot roll finish temperature was above 900° C., and the finished band was placed in a furnace set at 675° C. and then allowed to cool in about 24 hours to simulate slow coil cooling. The mechanical tensile properties of the hot band are presented in Table 2.

For all tables, YS=Yield Strength; YPE=Yield Point Elongation; UTS=Ultimate Tensile Strength; TE=Total Elongation. When YPE is present the YS value reported is the Upper Yield Point, otherwise 0.2% offset yield strength is reported when continuous yielding occurred.

TABLE 1

Nominal chemical composition of the alloy 41.

| Alloy | C | Mn | Al | Si | $M_s$ [° C.] Bulk |
|---|---|---|---|---|---|
| 41 | 0.25 | 4 | 1 | 2 | 330 |

TABLE 2

Mechanical tensile properties of alloy 41 hot band.

| ID | Thickness mm | Width mm | 0.5% Y.S. MPa | 0.2% off set Yield MPa | UTS MPa | 25.4 mm gauge length Elongation Measured % |
|---|---|---|---|---|---|---|
| 41 | 3.62 | 9.55 | 723 | 746 | 1083 | 20.8 |

The calculated phase fraction of ferrite (bcc), austenite (fcc) and cementite ($Fe_3C$), as well as the carbon content of the austenite for alloy 41, plotted with temperature, is presented in FIGS. 1 and 1*a*.

The hot band was bead blasted and pickled to remove surface scale. The cleaned hot band was then cold reduced to a thickness of about 1.75 mm. The cold roll strip was then subjected to various heat treatments and the mechanical tensile properties were evaluated. The microstructures of the steel at each heat treatment were also characterized.

Example 2

Optimum Intercritical Annealing, Alloy 41

An optimum intercritical annealing for alloy 41 of Example 1 was applied by heating a cold rolled strip to a temperature of 720° C. for about 1 or 4 hours in a controlled atmosphere. At the end of the soaking time the strip was place in a cooled zone of a tube furnace where the strip could cool to room temperature at a rate similar to air cooling. The thermal cycle of the optimum heat treatment is shown in a diagram in FIG. 2. The tensile properties were characterized and are presented in Table 3. The engineering stress—engineering strain curve of the heat treated strip is presented in FIG. 3. After annealing, the microstructure consisted of a mixture of ferrite, martensite and austenite; the microstructures are presented in FIG. 4 and FIG. 5. This heat treatment resulted in outstanding properties well above those targeted by the 3$^{rd}$ Generation AHSS. The UTS were above 970 MPa with total elongations above 37%.

TABLE 3

Mechanical tensile properties of optimum intercritical heat treatment.

| ID | Thickness mm | Width mm | 0.5% Y.S. MPa | 0.2% off set Yield MPa | UTS MPa | 50.8 mm gauge length Elongation Measured % | 50.8 mm gauge length Elongation Extensometer % | 50.8 mm gauge length Uniform Elongation % |
|---|---|---|---|---|---|---|---|---|
| 41 1 hour | 1.76 | 12.67 | 506 | 501 | 978 | 38.6 | 37.3 | 34.1 |
| 41 4 hours | 1.67 | 12.73 | 558 | 555 | 972 | 40.3 | 38.9 | 35.8 |

Example 3

Batch Annealing at Optimum Intercritical Temperature, Alloy 41

A hot band of alloy 41 was subjected to a batch annealing cycle. The steel was heated in a controlled atmosphere at a rate of about 1° C./min up to a temperature of 720° C. The steel was held for 24 hours at that temperature, and then was cooled to room temperature in about 24 hours, for a cooling rate of about 0.5° C./min. The mechanical tensile properties are presented in Table 4. The microstructure consisted of a mixture of ferrite, martensite and retained austenite, FIG. 6 presents a light optical micrograph of the batch annealed hot band. The batch annealing cycle not only agglomerated the carbon around the martensite and retained austenite, but also has partitioned the manganese. When this hot band is cold reduced and annealed again, the carbon and manganese does not have long diffusion distances to displace and enrich the austenite, stabilizing it to room temperature.

TABLE 4

Mechanical tensile properties of hot band-optimum batch annealing heat treatment.

| ID | Thickness mm | Width mm | 0.5% Y.S. MPa | 0.2% off set Yield MPa | UTS MPa | 50.8 mm gauge length Elongation Measured % | Elongation Extensometer % | Uniform Elongation % |
|---|---|---|---|---|---|---|---|---|
| 41 HB | 3.86 | 12.73 | 460 | 458 | 821 | 17.7 | 19.7 | 13.3 |

The cold rolled alloy 41 was subjected to a batch annealing cycle. The steel was heated in a controlled atmosphere furnace at 5.55° C./min up to the temperature of 720° C. The steel was held for 12 hours at temperature, and then it was cooled to room temperature at about 1.1° C./min. The heating cycle is presented in FIG. 7. The mechanical tensile properties are presented on Table 5. Some of these properties are similar to tensile properties of dual phase steel, with a tensile strength around 898 MPa and a total elongation of 20.6%, but with low YS of around 430 MPa. The low YS is believed to be the result of retained austenite in the microstructure. The engineering stress-engineering strain curve is presented in FIG. 8. The microstructure from light optical microscopy is presented in FIG. 9.

TABLE 5

Mechanical tensile properties of optimum batch annealing heat treatment.

| ID | Thickness mm | Width mm | 0.5% Y.S. MPa | 0.2% off set Yield MPa | UTS MPa | 50.8 mm gauge length Elongation Measured % | Elongation Extensometer % | Uniform Elongation % |
|---|---|---|---|---|---|---|---|---|
| 41 BA | 1.78 | 12.65 | 447 | 430 | 898 | 20.6 | 20.4 | 14.6 |

Example 4

Continuous Annealing Simulated Cycle after Batch Annealing, Alloy 41

The batch annealing cycle is a preferable carbon partitioning heat treatment. At the intercritical temperature almost all of the carbon is concentrated in the austenite. Because the solubility of manganese in austenite is larger than in ferrite, manganese also partitions or redistributes from ferrite to the austenite. Manganese is a substitutional element and its diffusivity is significantly slower than that of carbon, which is an interstitial element, and it takes longer to partition. Alloy 41 with the silicon and aluminum additions is designed to have the desired intercritical temperature at a temperature at which the carbon and manganese portioning occurs at a practical time. When cooled down slowly some of the austenite decomposes into martensite, some decomposes into carbides, and little austenite is retained. The intercritical ferrite is nearly carbon free. When the steel is then continuously annealed, it is heated again to the desired intercritical temperature and the distance that carbon and the manganese must diffuse across to partitioning between phases is shorter than before the first thermal cycle. The martensite and the carbides reverse back into austenite. The batch annealing cycle partitions and arranges the C and Mn, so when continuously annealed, the diffusivity distances are shorter, and the reversion to austenite occurs faster.

After cold rolling and batch annealing at the optimum intercritical temperature, alloy 41 was subjected to a simulated continuous annealing cycle by soaking the steel in a salt pot for 5 min. at its optimum intercritical temperature of 720° C. or 740° C. The resulting tensile properties are presented on Table 6. The second heat treatment brought back the 3$^{rd}$ Generation AHSS properties of the steel from the batch annealing properties. Some differences between the two temperatures were observed; for instance, the higher continuous annealing temperature of 740° C. produced a YS of 443 MPa, a UTS of 982 MPa, and T.E. of 30%. The continuous annealing temperature of 720° C. resulted in slightly higher YS of about 467 MPa, with a lower UTS of 882 MPa and a larger T. E. of 36.6%. It is believed that at the lower annealing temperature of 720° C., the volume fraction of austenite is lower but it contains more carbon. The higher carbon in the austenite makes it more stable at room temperature, resulting in lower UTS and higher T.E. % compared to the higher 740° C. annealing temperature, which is believed to provide higher volumes fraction of austenite, but with less carbon content, and so is less stable. The engineering stress-strain curves for these two heat treatments are presented in FIG. 10, and their corresponding microstructures in FIGS. 11 and 12.

TABLE 6

Mechanical tensile properties of optimum batch annealed and continuously anneal simulated steel.

| ID | Thickness mm | Width mm | 0.5% Y.S. MPa | 0.2% off set Yield MPa | UTS MPa | 50.8 mm gauge length Elongation Measured % | Elongation Extensometer % | Uniform Elongation % |
|---|---|---|---|---|---|---|---|---|
| 41 BA 720 + CA 720 | 1.76 | 12.67 | 479 | 467 | 882 | 36.6 | 35.4 | 32.4 |
| 41 BA 720 + CA 740 | 1.75 | 12.69 | 459 | 443 | 982 | 30.0 | 28.4 | 26.8 |

Example 5

Continuously Annealing at Modified Temperature, Alloy 41

One simpler heat treatment cycle is continuously annealing the cold rolled steel. Due to the shorter times, the sluggish dissolution kinetics of the carbon carbides and the diffusivity distances of the carbon from ferrite to austenite, the optimum intercritical temperature for this alloy is less effective with this heat treatment process. Thus, an annealing temperature which is higher than the optimum temperature for the alloy is needed to overcome these obstacles. Cold rolled alloy 41 steel was subjected to a simulated continuous annealing cycle by inserting the steel in a tube furnace set at around 850° C. The steel temperature was monitored using contact thermocouples. The steel was in the heating zone of the furnace until the desired peak temperature was reached, and then the steel was placed in the cold zone of the furnace to slowly cool. Two peak metal temperatures (PMT) were chosen, 740 and 750° C. Thermal profile diagrams of the heat treatment are illustrated in FIG. 13. The resulting tensile properties are presented on Table 7, and the engineering stress-strain curves in FIG. 14. Both tensile tests showed some yield point elongation, especially the PMT of 740° C. where the YPE was about 3.4%, indicating a great amount of carbon still residing in the ferrite, and not enough time to diffuse to the austenite. At the lower PMT of 740° C. the steel showed 734 MPa YS, 850 UTS, and 26.7% T. E. At the higher PMT of 750° C., the YPE is reduced to 0.6%, a lower YS of 582 MPa, higher UTS of 989 MPa, and a lower T. E. of 24.1%. The higher PMT resulted in more austenite but the carbon content of this austenite was lower, as indicated by the lower YS and higher UTS. These properties are somewhat lower than the target 3$^{rd}$ Generation AHSS, however are well above those achieve by dual phase steels, and are comparable to properties reported by other types of AHSS such as TRIP and Q&P, but without the use of any special heat treatment.

TABLE 7

Mechanical tensile properties of continuously annealed steel.

| ID | Thickness mm | Width mm | YPE % | Upper Yield Point MPa | UTS MPa | 50.8 mm gauge length Elongation Measured % | Elongation Extensometer % | Uniform Elongation % |
|---|---|---|---|---|---|---|---|---|
| 41 CA 740 | 1.75 | 12.66 | 3.4 | 734 | 850 | 26.7 | 24.5 | 17.8 |
| 41 CA 750 | 1.73 | 12.68 | 0.6 | 582 | 989 | 24.1 | 23.9 | 20.4 |

Example 6

Continuously Annealing, Hot-Dip Coating Line Simulations, in Tunnel Belt Furnace, Alloy 41

Another way to simulate a continuously annealing heat cycle is to use a tube furnace equipped with a conveyor belt. Cold rolled steel from alloy 41 was subjected to continuously annealing simulations in a belt tunnel furnace with protective $N_2$ atmosphere, imitating the temperature profile of a hot dip coating line with peak metal temperatures from 748-784° C. The temperatures of the samples were recorded using thermocouples, while the temperature of the furnace was altered by changing the set points of the various tunnel zones. Examples of 2 temperature profiles with time are presented in FIG. 15. An example of the engineering stress-engineering strain curve for a specimen annealed at a peak metal temperature of 755 C is presented in FIG. 16. The summary of the tensile properties of the steels for all the simulations are presented on Table 8 for the temperatures from 748-784° C.

Another set of steel of alloy 41 was batch annealed in the hot band condition.

After batch annealing, the steel was cold rolled about 50%. The cold reduced steel was then continuously annealed using a tube furnace equipped with a conveyor belt to simulate a hot-dip coating line. The temperature cycles were similar to those observed in FIG. 15. The peak metal temperatures ranged from about 750 to 800° C. The summary of resulting tensile properties are presented on Table 9. The steel that was hot band annealed before cold rolling showed lower yield strengths and lower tensile strengths, but higher total elongations. The batch annealing cycle arranged the carbon and manganese in clusters where they, during the continuous annealing cycle, had a shorter diffusion distance to enriched the austenite and stabilize it at room temperature.

TABLE 8

Mechanical tensile properties of continuously anneal simulated steel, using a hot-dip galvanizing line temperature cycle.

| HDGL peak metal temperature ° C. | Thickness mm | Width mm | YPE % | YS MPa | UTS MPa | 50.8 mm gauge length Elongation Measured % | Elongation Extensometer % | Uniform Elongation % |
|---|---|---|---|---|---|---|---|---|
| 748 | 1.84 | 12.66 | 2.7 | 732 | 1068 | 23.0 | 21.0 | 17.2 |
| 751 | 1.83 | 12.66 | 2.7 | 670 | 1092 | 21.4 | 21.8 | 18.3 |
| 757 | 1.85 | 12.69 | 2.6 | 689 | 1153 | 18.9 | 18.3 | 16.6 |
| 762 | 1.84 | 12.69 | 3.6 | 653 | 1184 | 17.4 | 19.7 | 17.6 |
| 774 | 1.87 | 12.67 | | 553 | 1284 | 11.9 | 12.4 | 12.4 |
| 784 | 1.86 | 12.64 | | 503 | 1332 | 16.0 | 15.5 | 14.2 |

TABLE 9

Mechanical tensile properties of hot band batch annealed, cold reduced, and continuously anneal simulated steel, using a hot-dip galvanizing line temperature cycle.

| HDGL peak metal temperature ° C. | Thickness mm | Width mm | YPE % | YS MPa | UTS MPa | 50.8 mm gauge length Elongation Measured % | Elongation Extensometer % | Uniform Elongation % |
|---|---|---|---|---|---|---|---|---|
| 750 | 1.91 | 12.65 | | 533 | 890 | 31.7 | 31.9 | 27.3 |
| 755 | 1.87 | 12.65 | 0.7 | 522 | 908 | 30.7 | 30.8 | 26.2 |
| 760 | 1.88 | 12.72 | 1.4 | 505 | 938 | 28.3 | 28.7 | 23.9 |
| 765 | 1.87 | 12.68 | 1.6 | 482 | 927 | 27.5 | 27.4 | 23.3 |
| 770 | 1.91 | 12.68 | 1.3 | 468 | 987 | 26.3 | 26.2 | 23.0 |
| 770 | 1.92 | 12.69 | | 454 | 1031 | 23.8 | 24.7 | 21.5 |
| 778 | 1.91 | 12.70 | | 396 | 1060 | 21.7 | 22.6 | 19.0 |
| 782 | 1.89 | 12.73 | | 377 | 1067 | 10.5 | 11.1 | 11.1 |
| 790 | 1.92 | 12.70 | | 388 | 1120 | 14.5 | 16.5 | 15.1 |
| 800 | 1.87 | 12.72 | | 406 | 1084 | 14.7 | 15.8 | 15.3 |

Example 7

Steel Making and Hot Rolling: Alloy 61.

Alloy 61 was melted and cast following typical steelmaking procedures. Alloy 61 comprises 0.25 wt % C, 4.0 wt % Mn, 1.0 wt Al, 2.0 wt % Si, and a small addition of 0.040 wt % Nb for grain growth control, Table 10. The ingot was cut and cleaned prior to hot rolling. The now 127 mm wide×127 mm long×48 mm thick ingot was heated to about 1250° C. for 3 h, and hot rolled to a thickness of about 3.6 mm in about 8 passes. The hot roll finish temperature was above 900° C., and the finished band was placed in a furnace set at 649° C. and then allowed to cool in about 24 hours to simulate slow coil cooling. The mechanical tensile properties of the hot band are presented on Table 11. In preparation for further processing, the hot bands were bead-blasted to remove scale formed during hot rolling, and after were pickled in HCl acid.

TABLE 10

Nominal chemical composition of the alloy 61.

| Alloy | C | Mn | Al | Si | Nb | $M_s$ [° C.] Bulk |
|---|---|---|---|---|---|---|
| 61 | 0.25 | 4 | 1 | 2 | 0.040 | 330 |

TABLE 11

Mechanical tensile properties of alloy 61 hot band.

| ID | Thickness mm | Width mm | 0.5% Y.S. MPa | 0.2% off set Yield MPa | UTS MPa | 50.8 mm gauge length Elongation Measured % |
|---|---|---|---|---|---|---|
| 61 | 3.27 | 12.76 | 701 | 866 | 1383 | 10.3 |

Example 8

Hot Band Batch Annealing, Alloy 61

The hot band was batch annealed at the optimum intercritical temperature. The band was heated to the optimum intercritical temperature of 720° C. in 12 hours, and soaked at that temperature for 24 hours. After the band was cooled to room temperature in the furnace in 24 hours. All heat treatments were performed in a controlled atmosphere of $H_2$. The tensile properties of the annealed hot band are presented on Table 12. The combination of high tensile strength and total elongation correspond to a dual-phase type of microstructure. The low value of YS is evidence of some retained austenite. FIG. 17 shows the microstructure of the batch annealed hot band.

TABLE 12

Mechanical tensile properties of alloy 61 hot band batch annealed.

| ID | Thickness mm | Width mm | 0.5% Y.S. MPa | 0.2% off set Yield MPa | UTS MPa | 50.8 mm gauge length Elongation Measured % |
|---|---|---|---|---|---|---|
| 61 | 3.38 | 12.76 | 486 | 490 | 804 | 16.9 |

Example 9

Hot Band Continuously Annealing or Anneal Pickle Line Simulation, Alloy 61

The hot band was also annealed in a belt furnace to simulate conditions similar to an annealing/pickling line. The annealing temperature or peak-metal temperature was between 750-760° C., the heating time was around 200 seconds, followed by air cooling to room temperature. The heat treatment was performed in an atmosphere of $N_2$ to prevent oxidation. The resulting tensile properties are presented on Table 13. The resulting tensile strength and total elongation surpassed already the 3$^{rd}$ Generation AHSS targets, resulting in a UTS*T.E. product of 31,202 MPa*%. The microstructure includes a fine distribution of ferrite, austenite and martensite, FIG. 18.

TABLE 13

Mechanical tensile properties of alloy 61 hot band continuously annealed or anneal/pickle line simulated.

| ID | Thickness mm | Width mm | 0.5% Y.S. MPa | 0.2% off set Yield MPa | UTS MPa | 50.8 mm gauge length Elongation Measured % |
|---|---|---|---|---|---|---|
| 61 | 3.42 | 12.69 | 655 | 670 | 1233 | 25.3 |

Example 10

Continuous Annealing Simulation of Intercritical Annealed Cold Rolled Steel, Alloy 61

The continuously annealed hot band or annealed/pickled simulated hot band was cold reduced over 50%. The now cold reduced steel was subjected to a continuous annealing heat treatment in a belt tunnel furnace with a protective atmosphere of $N_2$. The temperature profile in the furnace as well as the belt speeds were programmed to simulate a Continuous Hot Dip Coating Line profile. A range of annealing temperatures were simulated from around 747 to 782° C. The resulting tensile properties are listed on Table 14. The tensile properties all were above the target of 3$^{rd}$ Generation AHSS, with YS between 803-892 MPa, UTS between 1176-1310 MPa, with T.E. between 28-34%. All for a UTS*T.E. product of 37,017-41,412 MPa*%. The resulting microstructure is presented in FIG. 19.

TABLE 14

Mechanical tensile properties of optimum intercritical annealed/cold rolled and continuously anneal simulated Alloy 61.

| Anneal temp. ° C. | Thick mm | Width mm | 0.5% Y.S. MPa | 0.2% off set Yield MPa | UTS MPa | 50.8 mm gauge length Elongation Measured % | 50.8 mm gauge length Elongation Extensometer % | 50.8 mm gauge length Uniform Elongation % |
|---|---|---|---|---|---|---|---|---|
| 747 | 1.44 | 12.68 | 865 | 892.4 | 1176 | 34.7 | 34.0 | 31.3 |
| 749 | 1.44 | 12.73 | 832 | 871.8 | 1192 | 31.4 | 30.7 | 27.4 |
| 757 | 1.45 | 12.67 | 860 | 876 | 1225 | 33.8 | 33.3 | 30.3 |
| 762 | 1.48 | 12.65 | 838 | 860 | 1257 | 30.9 | 30.8 | 26.6 |
| 768 | 1.44 | 12.66 | 850 | 886.9 | 1237 | 32.0 | 31.7 | 29.4 |
| 773 | 1.47 | 12.68 | 839 | 831.3 | 1272 | 30.2 | 29.9 | 27.2 |
| 775 | 1.46 | 12.70 | 833 | 823.8 | 1310 | 29.1 | 28.9 | 26.3 |
| 777 | 1.48 | 12.71 | 821 | 803.5 | 1295 | 28.6 | 28.1 | 25.4 |
| 782 | 1.44 | 22.69 | 850 | 846 | 1301 | 29.1 | 28.1 | 23.2 |

SUMMARY

A summary table of tensile properties described in this disclosure is presented on Table 15, and Table 16. The steels were designed to develop a microstructure comprising ferrite, martensite and austenite when annealed at the optimum temperature for the alloy to enrich the austenite with carbon and manganese. This microstructure combination results in mechanical tensile properties well above those of the 3$^{rd}$ Generation Advanced High Strength Steels. The steels have tensile properties similar to other steels that used higher amounts of alloying to stabilized austenite (higher Mn, Cr, Ni, Cu, etc.). By applying an optimum intercritical annealing to the steels of the present application, the carbon and manganese is used as an austenite stabilizing element, and results in outstanding tensile properties. Other more typical heat treatments also resulted in tensile properties in the 3rd Generation of AHSS, such as batch annealing and continuous simulated annealing. A straight continuous annealing heat treatment developed properties that are less than but very close to the 3rd Generation AHSS target; however, the developed properties are similar to those exhibited by TRIP and Q&P steels. When the steel was batch annealed either in the hot band or in the cold rolled condition, the carbon and manganese cluster in regions, allowing easier and shorter diffusion distances for later intercritical annealing. These steels, when continuously annealed, showed properties in the 3rd Generation AHSS target. The Nb addition in one embodiment forms NbC, which control structure grain size, by avoiding grain growth, and serving as nucleation sites for ferrite formation. The grain size control of such an embodiment can result in an improvement of properties compared to embodiments without the addition of niobium, and its tensile properties are well in the target of those for 3rd Generation AHSS.

TABLE 15

Tensile properties summary table for the different heat treatments for alloy 41.

| Description | Thickness mm | Width mm | YPE % | 0.2% off set Yield MPa | UTS MPa | 50.8 mm gauge length Total Elongation % | UTS* T.E. MPa* % |
|---|---|---|---|---|---|---|---|
| Optimal Intercritical Annealing | | | | | | | |
| 1 hour | 1.76 | 12.67 | 506 | 501 | 978 | 38.6 | 37,751 |
| 4 hours | 1.67 | 12.73 | 558 | 555 | 972 | 40.3 | 39,172 |
| Continuously annealed | | | | | | | |
| CA 740 | 1.75 | 12.66 | 3.4 | 734 | 850 | 26.7 | 22,695 |
| CA 750 | 1.73 | 12.68 | 0.6 | 582 | 989 | 24.1 | 23,835 |
| CA-748 | 1.84 | 12.66 | 2.7 | 732 | 1068 | 23.0 | 24,564 |
| CA-751 | 1.83 | 12.66 | 2.7 | 670 | 1092 | 21.4 | 23,369 |
| CA-757 | 1.85 | 12.69 | 2.6 | 689 | 1153 | 18.9 | 21,792 |
| CA-762 | 1.84 | 12.69 | 3.6 | 653 | 1184 | 17.4 | 20,602 |
| CA-774 | 1.87 | 12.67 | | 553 | 1284 | 11.9 | 15,280 |
| CA-784 | 1.86 | 12.64 | | 503 | 1332 | 16.0 | 21,312 |
| Batch Annealed and Continuously Annealed | | | | | | | |
| BA 720 + CA 720 | 1.76 | 12.67 | 479 | 467 | 882 | 36.6 | 32,281 |
| BA 720 + CA 740 | 1.75 | 12.69 | 459 | 443 | 982 | 30 | 29,460 |
| BA 720-CA-750 | 1.91 | 12.65 | | 533 | 890 | 31.7 | 28,213 |
| BA 720-CA-755 | 1.87 | 12.65 | 0.7 | 522 | 908 | 30.7 | 27,876 |
| BA 720-CA-760 | 1.88 | 12.72 | 1.4 | 505 | 938 | 28.3 | 26,545 |
| BA 720-CA-765 | 1.87 | 12.68 | 1.6 | 482 | 927 | 27.5 | 25,493 |
| BA 720-CA-770 | 1.91 | 12.68 | 1.3 | 468 | 987 | 26.3 | 25,958 |
| BA 720-CA-770 | 1.92 | 12.69 | | 454 | 1031 | 23.8 | 24,538 |
| BA 720-CA-778 | 1.91 | 12.70 | | 396 | 1060 | 21.7 | 23,002 |
| BA 720-CA-782 | 1.89 | 12.73 | | 377 | 1067 | 10.5 | 11,204 |
| BA 720-CA-790 | 1.92 | 12.70 | | 388 | 1120 | 14.5 | 16,240 |
| BA 720-CA-800 | 1.87 | 12.72 | | 406 | 1084 | 14.7 | 15,935 |

TABLE 16

Tensile properties summary table for the different heat treatments for alloy 61.

| Description | Thickness mm | Width mm | YPE % | 0.2% off set Yield MPa | UTS MPa | 50.8 mm gauge length Total Elongation % | UTS*T.E. MPa* % |
|---|---|---|---|---|---|---|---|
| Hot Band | 3.27 | 12.76 | | 833 | 1383 | 10.3 | 14245 |
| Hot Band, Batch Annealed | 3.38 | 12.76 | | 490 | 804 | 16.9 | 13588 |
| Hot Band, Continuously Annealed | 3.42 | 12.69 | | 670 | 1233 | 25.3 | 31195 |
| Cold rolled, optimum intercritical annealed and Continuously Annealed | | | | | | | |
| 747 | 1.44 | 12.68 | | 892.4 | 1176 | 34.7 | 40807 |
| 749 | 1.44 | 12.73 | | 871.8 | 1192 | 31.4 | 37429 |
| 757 | 1.45 | 12.67 | | 876 | 1225 | 33.8 | 41405 |
| 762 | 1.48 | 12.65 | | 860 | 1257 | 30.9 | 38841 |
| 768 | 1.44 | 12.66 | | 886.9 | 1237 | 32.0 | 39584 |
| 773 | 1.47 | 12.68 | | 831.3 | 1272 | 30.2 | 38414 |
| 775 | 1.46 | 12.70 | | 823.8 | 1310 | 29.1 | 38121 |
| 777 | 1.48 | 12.71 | | 803.5 | 1295 | 28.6 | 37037 |
| 782 | 1.44 | 22.69 | | 846 | 1301 | 29.1 | 37859 |

What is claimed is:

1. A high strength steel comprising 0.20-0.3 wt % C, 3.5-4.5 wt % Mn, with the sum of the Al and Si additions of 2.6 to 3.6% such that an optimum intercritical temperature is above 700° C., wherein, during intercritical annealing, the high strength steel includes about 20-80% volume ferrite and 20-80% austenite, and wherein the Ms temperature calculated for the austenite phase during intercritical anneal ≤100° C.

2. The high strength steel of claim 1, wherein the intercritical annealing occurs in a batch process.

3. The high strength steel of claim 1, wherein the intercritical annealing occurs in a continuous process.

4. The high strength steel of claim 1, having a tensile elongation of at least 20% and an ultimate tensile strength of at least 880 MPa.

5. The high strength steel of claim 1 further comprising 0.8-1.3 wt % Al, 1.8-2.3 wt % Si, and the balance of Fe, and impurities.

6. The high strength steel of claim 1 further comprising 0.8-1.3 wt % Al, 1.8-2.3 wt % Si, 0.030-0.050 wt % Nb, and the balance of Fe, and impurities.

7. The high strength steel of claim 1, wherein after hot rolling, said steel has a tensile strength of at least 1000 MPa, and a total elongation of at least 15%.

8. The high strength steel of claim 1, wherein after hot rolling, said steel has a tensile strength of at least 1300 MPa, and a total elongation of at least 10%.

9. The high strength steel of claim 1, wherein after hot rolling and continuous annealing, said steel has a tensile strength of at least 1000 MPa and a total elongation of at least 20%.

* * * * *